US011176881B2

(12) United States Patent
Roh et al.

(10) Patent No.: US 11,176,881 B2
(45) Date of Patent: Nov. 16, 2021

(54) ORGANIC LIGHT EMITTING DIODE DISPLAY DEVICE CAPABLE OF PERFORMING LOW FREQUENCY DRIVING, AND METHOD OF OPERATING THE SAME

(71) Applicant: Samsung Display Co., Ltd., Yongin-Si (KR)

(72) Inventors: Jinyoung Roh, Hwaseong-si (KR); Sangan Kwon, Cheonan-si (KR); Sehyuk Park, Seongnam-si (KR); Hyojin Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/921,329

(22) Filed: Jul. 6, 2020

(65) Prior Publication Data

US 2021/0043140 A1 Feb. 11, 2021

(30) Foreign Application Priority Data

Aug. 8, 2019 (KR) ..... 10-2019-0096725

(51) Int. Cl.
*G09G 3/3233* (2016.01)
*G09G 3/3283* (2016.01)
(Continued)

(52) U.S. Cl.
CPC ..... *G09G 3/3233* (2013.01); *G09G 3/2003* (2013.01); *G09G 3/3266* (2013.01); *G09G 3/3283* (2013.01); *G09G 2320/0247* (2013.01); *G09G 2320/0666* (2013.01); *G09G 2330/021* (2013.01)

(58) Field of Classification Search
CPC .. G09G 3/3233; G09G 3/2003; G09G 3/3266; G09G 2320/0247; G09G 2320/0666; G09G 2330/021
See application file for complete search history.

(56) References Cited

U.S. PATENT DOCUMENTS

| | | | | |
|---|---|---|---|---|
| 10,262,569 | B2 * | 4/2019 | Watanabe | G09G 3/3648 |
| 2005/0018920 | A1 * | 1/2005 | Ramamurthy | H04N 5/2357 382/254 |
| 2017/0041542 | A1 * | 2/2017 | Ono | H04N 5/23254 |

FOREIGN PATENT DOCUMENTS

| | | | |
|---|---|---|---|
| KR | 10-2014-0011701 | A | 1/2014 |
| KR | 10-2015-0094881 | A | 8/2015 |

(Continued)

*Primary Examiner* — Kenneth B Lee, Jr.
(74) *Attorney, Agent, or Firm* — Innovation Counsel LLP

(57) ABSTRACT

A display device includes a display panel and a panel driver configured to drive the display panel. The panel driver receives input image data corresponding to first, second, and third colors at an input frame frequency, and detects whether the input image data represent a still or dynamic image. If the input image data represent the dynamic image, the panel driver drives the display panel at a first output frame frequency substantially the same as the input frame frequency. If the input image data represent the still image, the panel driver calculates a plurality of flicker indexes of the still image for at least two of the first, second, third colors, one or more combinations of the first, second, and third colors, and drives the display panel at a second output frame frequency that is determined based on the plurality of flicker indexes.

20 Claims, 12 Drawing Sheets

(51) Int. Cl.
*G09G 3/3266* (2016.01)
*G09G 3/20* (2006.01)

(56) References Cited

FOREIGN PATENT DOCUMENTS

| | | | |
|---|---|---|---|
| KR | 10-2017-0010175 | A | 1/2017 |
| KR | 10-1954934 | B1 | 3/2019 |

* cited by examiner

FIG. 8

310a

| COLOR | SENSITIVITY CORRELATION CONSTANT |
|---|---|
| RED | 0.2 |
| GREEN | 1.0 |
| BLUE | 0.5 |
| YELLOW | 0.9 |
| MAGENTA | 0.6 |
| CYAN | 0.9 |

FIG. 9

310b

| GRAY RANGE | RSCC | GSCC | BSCC | YSCC | MSCC | CSCC |
|---|---|---|---|---|---|---|
| 1~19 | 0.2 | 0.0 | 0.6 | 0.9 | 0.7 | 0.9 |
| 20~29 | 0.3 | 1.2 | 0.7 | 1.0 | 0.8 | 1.0 |
| 30~99 | 0.2 | 1.0 | 0.5 | 0.9 | 0.6 | 0.9 |
| 100~159 | 0.1 | 0.7 | 0.4 | 0.8 | 0.4 | 0.8 |
| 160~255 | 0.0 | 0.5 | 0.2 | 0.5 | 0.4 | 0.5 |

FIG. 10

360a

| FLICKER INDEX RANGE | DRIVING FREQUENCY |
|---|---|
| FIR1 | DFA |
| FIR2 | DFB |
| FIR3 | DFC |
| FIR4 | DFD |
| FIR5 | DFE |
| FIR6 | DFF |
| FIR7 | DFG |
| FIR8 | DFH |

ORGANIC LIGHT EMITTING DIODE DISPLAY DEVICE CAPABLE OF PERFORMING LOW FREQUENCY DRIVING, AND METHOD OF OPERATING THE SAME

CROSS-REFERENCE TO RELATED APPLICATION(S)

This application claims priority under 35 USC § 119 to Korean Patent Application No. 10-2019-0096725, filed on Aug. 8, 2019 in the Korean Intellectual Property Office (KIPO), the disclosure of which is incorporated herein in its entirety by reference.

BACKGROUND

1. Field

Example embodiments of the present inventive concept relate to a display device, and more particularly to a display device capable of performing low frequency driving, and a method of operating the display device.

2. Description of the Related Art

Reduction of power consumption is desirable in a display device such as an organic light emitting diode (OLED) display device, particularly when the display device is employed in a portable device, such as a smartphone, a tablet computer, etc. Recently, to reduce the power consumption of the OLED display device, a low frequency driving scheme that drives or refreshes a display panel at a frequency lower than an input frame frequency of input image data has been developed.

In a conventional OLED display device employing the low frequency driving scheme, a single flicker index may be calculated based on a luminance of a still image, and the frequency of the low frequency driving may be determined based on the single flicker index. The conventional OLED display device may operate at the same low driving frequency even if different still images may have the same luminance, and/or the luminance for respective colors may be different in the different still images.

SUMMARY

Some example embodiments of the present disclosure provide a display device including an organic light emitting diode (OLED) display device capable of minimizing or eliminating a flicker that may be perceived by a viewer while reducing power consumption by performing low frequency driving.

According to an example embodiment, a display device includes a display panel and a panel driver configured to drive the display panel. The panel driver receives input image data corresponding to a first color, a second color, and a third color at an input frame frequency, and detects whether the input image data represent a still image or a dynamic image. In a first case where the input image data represent the dynamic image, the panel driver drives the display panel at a first output frame frequency that is equal to or substantially the same as the input frame frequency. In a second case where the input image data represent the still image, the panel driver calculates a plurality of flicker indexes of the still image for at least two of the first color, the second color, the third color, a first combination of the first color and the second color, a second combination of the first color and the third color, and a third combination of the second color and the third color based on the input image data, determines a second output frame frequency based on the plurality of flicker indexes, and drives the display panel at the second output frame frequency.

In example embodiments, the second output frame frequency may be lower than the input frame frequency.

In example embodiments, the first color may be a red color, the second color may be a green color, the third color may be a blue color, the first combination may be a yellow color, the second combination may be a magenta color, and the third combination may be a cyan color. The plurality of flicker indexes of the still image may include a red flicker index corresponding to the red color, a green flicker index corresponding to the green color, a blue flicker index corresponding to the blue color, a yellow flicker index corresponding to the yellow color, a magenta flicker index corresponding to the magenta color, and a cyan flicker index corresponding to the cyan color.

In example embodiments, in the second case where the input image data represent the still image, the panel driver may determine a plurality of driving frequencies respectively corresponding to the red flicker index, the green flicker index, the blue flicker index, the yellow flicker index, the magenta flicker index and the cyan flicker index and may determine the second output frame frequency as a maximum frequency of the plurality of driving frequencies.

In example embodiments, the display panel may include a plurality of pixels, and each of the plurality of pixels may include a driving transistor configured to generate a driving current, a display element configured to emit light based on the driving current, a switching transistor configured to transfer a data signal to a source of the driving transistor, a compensating transistor configured to diode-connect the driving transistor, a storage capacitor configured to store the data signal transferred through the switching transistor and the driving transistor, a first initializing transistor configured to provide an initialization voltage to the storage capacitor and a gate of the driving transistor, a first emission controlling transistor configured to connect a line of a power supply voltage to the source of the driving transistor, a second emission controlling transistor configured to connect a drain of the driving transistor to the display element, and a second initializing transistor configured to provide the initialization voltage to the display element. At least first one of the driving transistor, the switching transistor, the compensating transistor, the first initializing transistor, the first emission controlling transistor, the second emission controlling transistor and the second initializing transistor may be implemented with a P-type metal-oxide-semiconductor (PMOS) transistor, and at least second one of the driving transistor, the switching transistor, the compensating transistor, the first initializing transistor, the first emission controlling transistor, the second emission controlling transistor and the second initializing transistor may be implemented with an N-type metal-oxide-semiconductor (NMOS) transistor.

In example embodiments, the display panel may include a plurality of pixels, and each of the plurality of pixels may include a driving transistor configured to generate a driving current, a first switching transistor configured to transfer a data signal, a storage capacitor configured to store the data signal transferred through the first switching transistor, a second switching transistor configured to connect the storage capacitor and the driving transistor to an initialization line, an emission controlling transistor configured to connect a line of a power supply voltage to the driving transistor, and a display element configured to emit light based on the driving current. At least first one of the driving transistor, the first switching transistor, the second switching transistor, and the emission controlling transistor may be implemented with a PMOS transistor, and at least second one of the driving transistor, the first switching transistor, the second switching transistor, and the emission controlling transistor may be implemented with an NMOS transistor.

In example embodiments, the panel driver may include a still image detector configured to detect whether the input image data represent the still image by comparing the input image data in a previous frame and the input image data in a current frame, a driving frequency changer configured to provide output image data at the first output frame frequency in the first case where the input image data represent the dynamic image, and to provide the output image data at the second output frame frequency that is determined based on the plurality of flicker indexes in the second case where the input image data represent the still image, and a data driver configured to provide data signals to a plurality of pixels of the display panel based on the output image data.

In example embodiments, the driving frequency changer may include a color-constant lookup table configured to store first through sixth sensitivity correlation constants for the first color, the second color, the third color, the first combination, the second combination, and the third combination, a flicker index calculation block configured to calculate first, second, and third average gray values for the first, second, and third colors based on the input image data, to perform a color conversion operation on the input image data, to calculate fourth, fifth, and sixth average gray values for the first, second, and third combinations based on the input image data on which the color conversion operation is performed, and to calculate first through sixth flicker indexes as the plurality of flicker indexes by multiplying the first through sixth average gray values by the first through sixth sensitivity correlation constants, respectively, a flicker-frequency lookup table configured to store a plurality of driving frequencies respectively corresponding to a plurality of flicker index ranges, and a driving frequency decision block configured to read first through sixth driving frequencies respectively corresponding to the first through sixth flicker indexes from the flicker-frequency lookup table, to determine the second output frame frequency as a maximum frequency of the first through sixth driving frequencies, and to provide the output image data at the second output frame frequency.

In example embodiments, the first color may be a red color, the second color may be a green color, the third color may be a blue color, the first combination may be a yellow color, the second combination may be a magenta color, and the third combination may be a cyan color. The color conversion operation performed by the flicker index calculation block may be a red/green/blue (RGB)-to-cyan/magenta/yellow/black (CMYK) conversion operation.

In example embodiments, the color-constant lookup table may store the first through sixth sensitivity correlation constants at each of a plurality of gray ranges. The flicker index calculation block may receive the first through sixth sensitivity correlation constants from the color-constant lookup table that respectively correspond to the first through sixth average gray values and may calculate the first through sixth flicker indexes by multiplying the first through sixth average gray values by the first through sixth sensitivity correlation constants, respectively.

In example embodiments, the flicker index calculation block may divide the input image data for one frame into a plurality of segment image data for a plurality of segments, calculate the first through sixth average gray values at each of the plurality of segments based on the plurality of segment image data and may calculate the first through sixth flicker ind exes at each of the plurality of segments by multiplying the first through sixth average gray values at each of the plurality of segments by the first through sixth sensitivity correlation constants, respectively. The driving frequency decision block may read the first through sixth driving frequencies at each of the plurality of segments respectively corresponding to the first through sixth flicker indexes at each of the plurality of segments from the flicker-frequency lookup table, determine each of a plurality of segment maximum driving frequencies at the plurality of segments as a segment maximum frequency of the first through sixth driving frequencies at each of the plurality of segments and may determine the second output frame frequency as a maximum frequency of the plurality of segment maximum driving frequencies at the plurality of segments.

In example embodiments, the driving frequency changer may include a color-constant lookup table configured to store first through sixth sensitivity correlation constants for the first color, the second color, the third color, the first combination, the second combination, and the third combination, a flicker index calculation block configured to calculate first, second, and third average gray values for the first, second, and third colors based on the input image data, to perform a color conversion operation on the input image data, to calculate fourth, fifth, and sixth average gray values for the first, second, and third combinations based on the input image data on which the color conversion operation is performed, and to calculate first through sixth flicker indexes as the plurality of flicker indexes by multiplying the first through sixth average gray values by the first through sixth sensitivity correlation constants, respectively, first through sixth flicker-frequency lookup tables respectively corresponding to the first color, the second color, the third color, the first combination, the second combination, and the third combination, each of the first through sixth flicker-frequency lookup tables may be configured to store a plurality of driving frequencies respectively corresponding to a plurality of flicker index ranges, and a driving frequency decision block configured to read first through sixth driving frequencies corresponding to the first through sixth flicker indexes from the first through sixth flicker-frequency lookup tables, respectively, to determine the second output frame frequency as a maximum frequency of the first through sixth driving frequencies, and to provide the output image data at the second output frame frequency.

According to an example embodiment, a method of operating an organic light emitting diode (OLED) display device includes receiving input image data corresponding to a first color, a second color, and a third color at an input frame frequency, and detecting whether the input image data represent a still image or a dynamic image. In a first case where the input image data represent the dynamic image, the display panel is driven at a first output frame frequency that is equal to or substantially the same as the input frame frequency. In a second case where the input image data represent the still image, a plurality of flicker indexes of the still image for at least two of the first color, the second color, the third color, a first combination of the first color and the second color, a second combination of the first color and the third color, and a third combination of the second color and the third color are calculated based on the input image data, a second output frame frequency is determined based on the plurality of flicker indexes, and the display panel is driven at the second output frame frequency.

In example embodiments, the second output frame frequency may be lower than the input frame frequency.

In example embodiments, the first color may be a red color, the second color may be a green color, the third color may be a blue color, the first combination may be a yellow color, the second combination may be a magenta color, and the third combination may be a cyan color. The plurality of flicker indexes of the still image may include a red flicker index corresponding to the red color, a green flicker index corresponding to the green color, a blue flicker index corresponding to the blue color, a yellow flicker index corresponding to the yellow color, a magenta flicker index corresponding to the magenta color, and a cyan flicker index corresponding to the cyan color.

In example embodiments, to determine the second output frame frequency based on the plurality of flicker indexes, a plurality of driving frequencies respectively corresponding to the red flicker index, the green flicker index, the blue flicker index, the yellow flicker index, the magenta flicker index, and the cyan flicker index may be determined, and the second output frame frequency may be determined as a maximum frequency of the plurality of driving frequencies.

In example embodiments, to detect whether the input image data represent the still image, the input image data in a previous frame and the input image data in a current frame may be compared, and it may be determined that the input image data represent the still image in the second case where the input image data in the current frame are equal to or substantially the same as the input image data in the previous frame.

In example embodiments, to calculate the plurality of flicker indexes of the still image, first, second, and third average gray values for the first, second, and third colors may be calculated based on the input image data, a color conversion operation may be performed on the input image data, fourth, fifth, and sixth average gray values for the first, second, and third combinations may be calculated based on the input image data on which the color conversion operation is performed, the first through sixth sensitivity correlation constants for the first color, the second color, the third color, the first combination, the second combination, and the third combination may be read from the color-constant lookup table, and first through sixth flicker indexes may be calculated as the plurality of flicker indexes by multiplying the first through sixth average gray values by the first through sixth sensitivity correlation constants, respectively.

In example embodiments, to determine the second output frame frequency based on the plurality of flicker indexes, first through sixth driving frequencies respectively corresponding to the first through sixth flicker indexes may be read from a flicker-frequency lookup table, and the second output frame frequency may be determined as a maximum frequency of the first through sixth driving frequencies.

In example embodiments, to determine the second output frame frequency based on the plurality of flicker indexes, first through sixth driving frequencies corresponding to the first through sixth flicker indexes may be read from first through sixth flicker-frequency lookup tables for the first color, the second color, the third color, the first combination, the second combination, and the third combination, respectively, and the second output frame frequency may be determined as a maximum frequency of the first through sixth driving frequencies.

As described above, in an OLED display device and a method of operating the OLED display device according to example embodiments, it may be determined whether input image data represent a still image or a dynamic image. If the input image data represent the still image, a plurality of flicker indexes of the still image for at least two of respective primary colors (e.g., a red color, a green color and a blue color) and combinations (e.g., a yellow color, a magenta color and a cyan color) of the primary colors may be calculated based on the input image data, a second output frame frequency (or a low driving frequency) may be determined based on the plurality of flicker indexes, and a display panel may be driven at the second output frame frequency. Accordingly, in cases where different still images may have substantially the same luminance value, but may have different luminances with respect to each of respective colors, the display panel may be driven at different low driving frequencies when displaying the still images according to the plurality of flicker indexes, and thus a flicker that may be perceived by a viewer may be eliminated or minimized while reducing the power consumption of the display device compared with a conventional display device that drives the display panel at the same low driving frequency based on a single flicker index.

BRIEF DESCRIPTION OF THE DRAWINGS

Illustrative, non-limiting example embodiments will be more clearly understood from the following detailed description in conjunction with the accompanying drawings.

FIG. 8 is a diagram illustrating an example of a color-constant lookup table.

FIG. 9 is a diagram illustrating another example of a color-constant lookup table.

FIG. 10 is a diagram illustrating an example of a flicker-frequency lookup table.

DETAILED DESCRIPTION OF THE EMBODIMENTS

Hereinafter, embodiments of the present inventive concept will be explained in detail with reference to the accompanying drawings.

Figure 1:
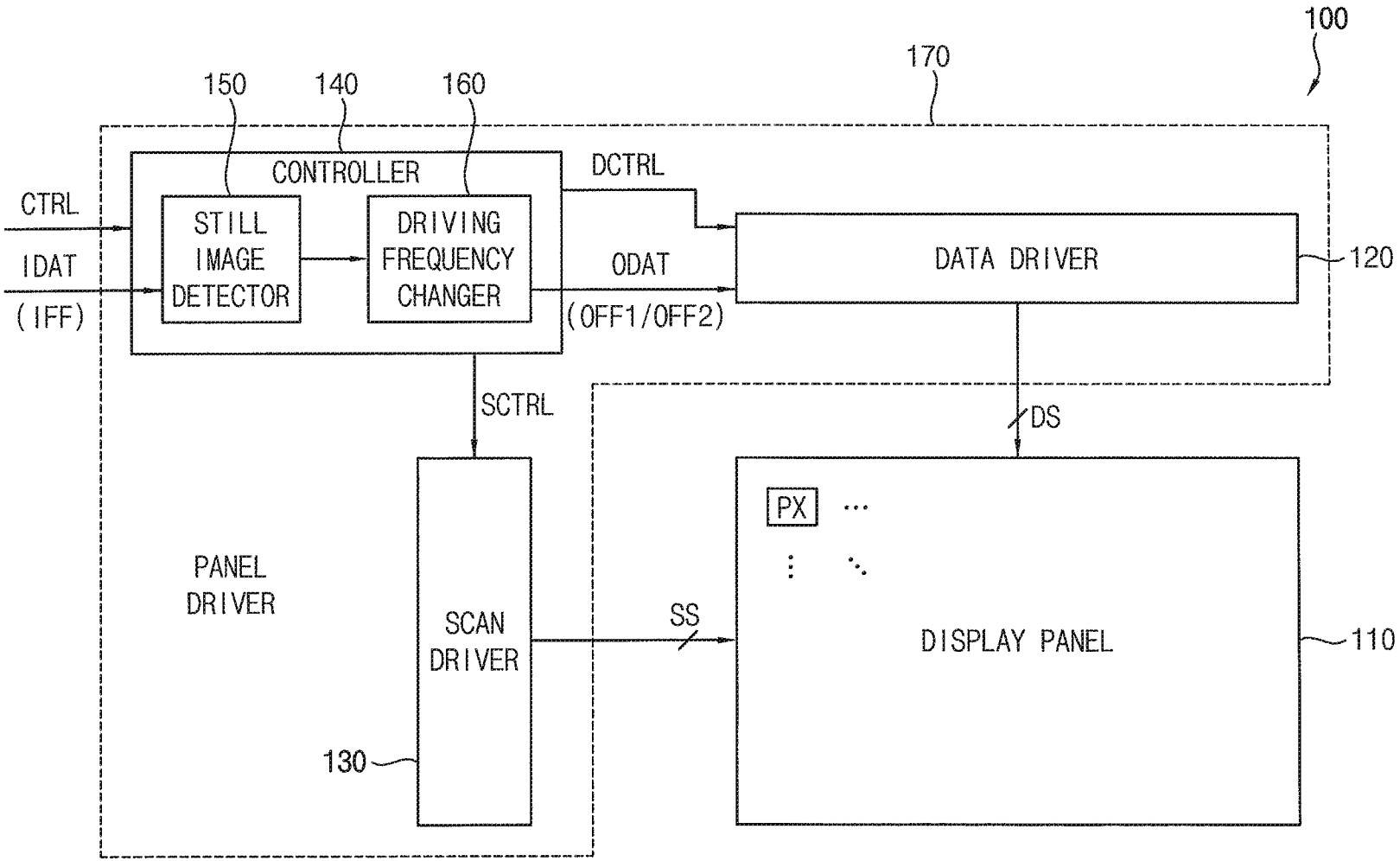
FIG. 1 is a block diagram illustrating an organic light emitting diode (OLED) display device according to an example embodiment.
Figure 2:
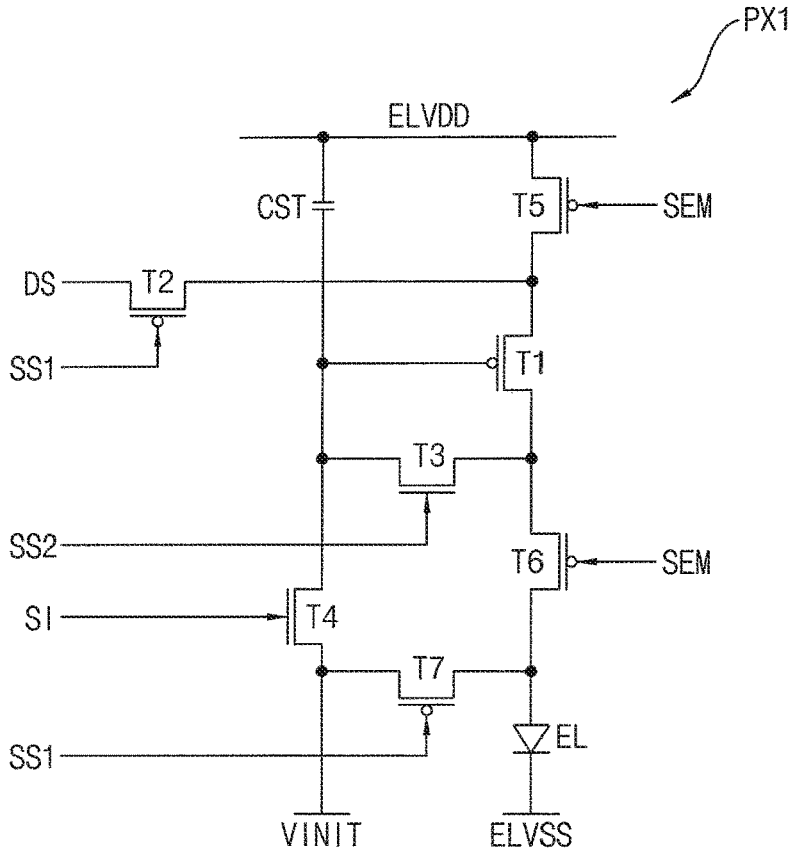
FIG. 2 is a circuit diagram illustrating an example of a pixel included in an OLED display device according to an example embodiment.
Figure 3:
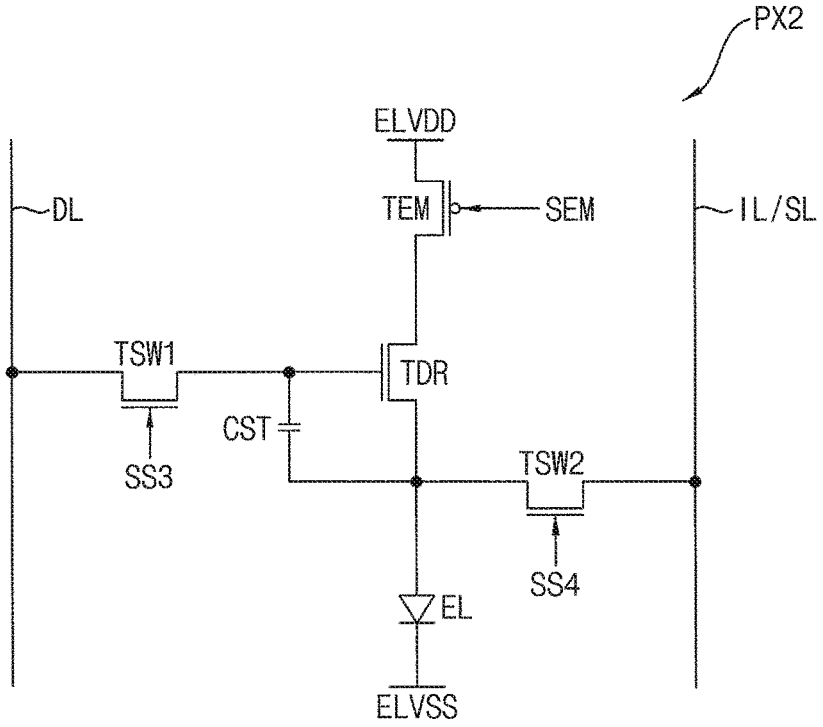
FIG. 3 is a circuit diagram illustrating an example of a pixel included in an OLED display device according to another example embodiment.

FIG. 1 is a block diagram illustrating an organic light emitting diode (OLED) display device according to an example embodiment, FIG. 2 is a circuit diagram illustrating an example of a pixel included in an OLED display device according to an example embodiment, and FIG. 3 is a circuit diagram illustrating an example of a pixel included in an OLED display device according to another example embodiment.

Referring to FIG. 1, an OLED display device 100 may include a display panel 110 that includes a plurality of pixels PX, and a panel driver 170 that drives the display panel 110. In some example embodiments, the panel driver 170 may include a data driver 120 that provides data signals DS to the plurality of pixels PX, a scan driver 130 that provides scan signals SS to the plurality of pixels PX, and a controller 140 that controls the data driver 120 and the scan driver 130.

The display panel 110 may include a plurality of data lines, a plurality of scan lines, and the plurality of pixels PX coupled to the respective ones of the plurality of data lines and the plurality of scan lines. In some example embodiments, each pixel PX may include at least one capacitor, at least two transistors and an organic light emitting diode (OLED), and the display panel 110 may be an OLED display panel. In some example embodiments, each pixel PX may be a hybrid oxide polycrystalline (HOP) pixel capable of performing low frequency driving while reducing power consumption. For example, the pixel PX may include at least one low-temperature polycrystalline silicon (LTPS) P-type metal-oxide-semiconductor (PMOS) transistor and at least one N-type metal-oxide-semiconductor (NMOS) transistor.

Referring to FIG. 2, a pixel PX1 includes a driving transistor T1 that is implemented with a PMOS transistor, and the driving transistor T1 generates a driving current. The pixel PX1 may further include a switching transistor T2 that transfers the data signal DS to a source of the driving transistor T1 in response to a first scan signal SS1 from the scan driver 130, a compensating transistor T3 that diode-connects the driving transistor T1 in response to a second scan signal SS2 from the scan driver 130, a storage capacitor CST that stores the data signal DS transferred through the switching transistor T2 and the diode-connected driving transistor T1, a first initializing transistor T4 that provides an initialization voltage VINIT to the storage capacitor CST and a gate of the driving transistor T1 in response to an initialization signal SI from the scan driver 130, a first emission controlling transistor T5 that connects a line of a high power supply voltage ELVDD to the source of the driving transistor T1 in response to an emission control signal SEM from an emission driver (not shown in FIG. 1), a second emission controlling transistor T6 that connect a drain of the driving transistor T1 to an OLED EL in response to the emission control signal SEM from the emission driver, a second initializing transistor T7 that provides the initialization voltage VINIT to the OLED EL in response to the first scan signal SS1 from the scan driver 130, and the OLED EL that emits light based on the driving current flowing from the line of the high power supply voltage ELVDD to a line of a low power supply voltage ELVSS.

In some example embodiments, at least first one of the driving transistor T1, the switching transistor T2, the compensating transistor T3, the first initializing transistor T4, the first emission controlling transistor T5, the second emission controlling transistor T6, and the second initializing transistor T7 may be implemented with a PMOS transistor, and at least second one of the driving transistor T1, the switching transistor T2, the compensating transistor T3, the first initializing transistor T4, the first emission controlling transistor T5, the second emission controlling transistor T6, and the second initializing transistor T7 may be implemented with an NMOS transistor. For example, as illustrated in FIG. 2, the compensating transistor T3 and the first initializing transistor T4 of which drains or sources are directly connected to the storage capacitor CST may be implemented with NMOS transistors, and the remaining transistors including the driving transistor T1, the switching transistor T2, the first emission controlling transistor T5, the second emission controlling transistor T6, and the second initializing transistor T7 may be implemented with PMOS transistors. In this case, the second scan signal SS2 and the initialization signal SI respectively applied to the compensating transistor T3 and the first initializing transistor T4 may be active high signals that are suitable for the NMOS transistors. Further, the second scan signal SS2 may be an inversion signal of the first scan signal SS1. Since the compensating transistor T3 and the first initializing transistor T4 that are directly connected to the storage capacitor CST are implemented with the NMOS transistors, a leakage current from the storage capacitor CST may be reduced, and thus the pixel PX1 may be suitable for the low frequency driving. Although FIG. 2 illustrates an example where the compensating transistor T3 and the first initializing transistor T4 are implemented with the NMOS transistors, a configuration of the pixel PX1 may not be limited to an example of FIG. 2. For example, in the pixel PX1, the switching transistor T2 also may be implemented with an NMOS transistor.

Referring to FIG. 3, a pixel PX2 includes a driving transistor TDR that is implemented with an NMOS transistor, the driving transistor TDR generates a driving current. The pixel PX2 may further include a first switching transistor TSW1 that transfers the data signal DS from a data line DL to the storage capacitor CST in response to a third scan signal SS3 from the scan driver 130, the storage capacitor CST that stores the data signal DS transferred through the first switching transistor TSW1, a second switching transistor TSW2 that connects the storage capacitor CST and the driving transistor TDR to an initialization line IL (or a sensing line SL) in response to a fourth scan signal SS4 from the scan driver 130, an emission controlling transistor TEM that connects a line of the high power supply voltage ELVDD to the driving transistor TDR in response to an emission control signal SEM from an emission driver, and the OLED EL that emits light based on the driving current flowing from the line of the high power supply voltage ELVDD to a line of the low power supply voltage ELVSS.

In some example embodiments, at least first one of the driving transistor TDR, the first switching transistor TSW1, the second switching transistor TSW2, and the emission controlling transistor TEM may be implemented with a PMOS transistor, and at least second one of the driving transistor TDR, the first switching transistor TSW1, the second switching transistor TSW2, and the emission controlling transistor TEM may be implemented with an NMOS transistor. For example, as illustrated in FIG. 3, the driving transistor TDR, the first switching transistor TSW1, and the second switching transistor TSW2 may be implemented with NMOS transistors, and the emission controlling transistor TEM may be implemented with a PMOS transistor.

Although FIGS. 2 and 3 illustrate the pixels PX1 and PX2 as examples of the pixel PX included in the OLED display device 100, the pixel PX may not be limited to the examples illustrated in FIGS. 2 and 3.

The data driver 120 may generate the data signals DS based on output image data ODAT and a data control signal DCTRL that are received from the controller 140 and provide the data signals DS to the plurality of pixels PX through the plurality of data lines. In a case where a still image is not displayed, or in a case where a dynamic (e.g., moving) image is displayed, the data driver 120 may receive from the controller 140 the output image data ODAT at a first output frame frequency OFF1 that is equal to or substantially the same as an input frame frequency IFF of input image data IDAT and drive the display panel 110 at the first output frame frequency OFF1 based on the output image data ODAT. Further, in a case where a still image is displayed, the data driver 120 may receive from the controller 140 the output image data ODAT at a second output frame frequency OFF2 that is lower than the input frame frequency IFF and drive the display panel 110 at the second output frame frequency OFF2 based on the output image data ODAT. In some example embodiments, the data control signal DCTRL may include, but not be limited to, an output data enable signal, a horizontal start signal, and a load signal. In some example embodiments, the data driver 120 and the controller 140 may be implemented with a single integrated circuit (IC), and the single integrated circuit may be referred to as a timing controller embedded data driver (TED). In other example embodiments, the data driver 120 and the controller 140 may be implemented with separate integrated circuits.

The scan driver 130 may provide the scan signals SS to the plurality of pixels PX through the plurality of scan lines based on a scan control signal SCTRL received from the controller 140. In some example embodiments, the scan driver 130 may sequentially provide the scan signals SS to the plurality of pixels PX on a row-by-row basis. Further, in some example embodiments, the scan control signal SCTRL may include, but not be limited to, a scan start signal and a scan clock signal. In some example embodiments, the scan driver 130 may be integrated or formed in a peripheral portion of the display panel 110. In other example embodiments, the scan driver 130 may be implemented in the form of an integrated circuit.

The controller 140 (e.g., a timing controller; TCON) may receive the input image data IDAT and a control signal CTRL from an external host processor (e.g., an application processor (AP), a graphic processing unit (GPU), a graphic card, etc.). In some example embodiments, the input image data IDAT may be an RGB image data including red image data, green image data, and blue image data. Further, in some example embodiments, the control signal CTRL may include, but not be limited to, a vertical synchronization signal, a horizontal synchronization signal, an input data enable signal, and a master clock signal. The controller 140 may generate the output image data ODAT, the data control signal DCTRL, and the scan control signal SCTRL based on the input image data IDAT and the control signal CTRL. The controller 140 may control an operation of the data driver 120 by providing the output image data ODAT and the data control signal DCTRL to the data driver 120 and control an operation of the scan driver 130 by providing the scan control signal SCTRL to the scan driver 130.

The controller 140 may receive the input image data IDAT at the input frame frequency IFF from the external host processor (not shown) and detect whether the input image data IDAT represent a still image. In some example embodiments, the input frame frequency IFF may be a constant frequency or a fixed frequency. For example, the input frame frequency IFF may be, but not be limited to, 60 Hz or 120 Hz. In a case where the input image data IDAT do not represent a still image, or in a case where the input image data IDAT represent a dynamic (e.g., moving) image, the controller 140 may control the data driver 120 and the scan driver 130 to drive the display panel 110 at the first output frame frequency OFF1 that is equal to or substantially the same as the input frame frequency IFF. In a case where the input image data IDAT represent a still image, the controller 140 may determine the second output frame frequency OFF2 that is lower than the input frame frequency IFF and control the data driver 120 and the scan driver 130 to drive the display panel 110 at the second output frame frequency OFF2.

In some example embodiments, the input image data IDAT may include a first image data for a first color, a second image data for a second color, and a third image data for a third color. The controller 140 may calculate a plurality of flicker indexes of the still image for at least two of the first color, the second color, the third color, a first combination of the first color and the second color, a second combination of the first color and the third color, and a third combination of the second color and the third color based on the input image data IDAT. The controller 140 may determine the second output frame frequency OFF2 based on the plurality of flicker indexes. For example, the first color may be a red color, the second color may be a green color, the third color may be a blue color, the first combination may be a yellow color, the second combination may be a magenta color, the third combination may be a cyan color. In this case, the controller 140 may calculate, as the plurality of flicker indexes of the still image, at least two or more of a red flicker index, a green flicker index, a blue flicker index, a yellow flicker index, a magenta flicker index, and a cyan flicker index of the still image. Further, the controller 140 may determine a plurality of driving frequencies respectively corresponding to the at least two or more of the red flicker index, the green flicker index, the blue flicker index, the yellow flicker index, the magenta flicker index, and the cyan flicker index. According to one embodiment, the controller 140 may determine the second output frame frequency OFF2 as the maximum frequency of the plurality of driving frequencies. According to some example embodiments, the controller 140 may perform these operations using a still image detector 150 and a driving frequency changer 160.

According to one embodiment, the still image detector 150 may detect whether the input image data IDAT represent a still image. For example, the still image detector 150 may compare the input image data IDAT in a previous frame and the input image data IDAT in a current frame and determine whether the input image data IDAT represent a still image. For example, the still image detector 160 may determine that the input image data IDAT do not represent an still image but represent a dynamic image if the input image data IDAT in the current frame are different from the input image data IDAT in the previous frame and determine that the input image data IDAT represent a still image if the input image data IDAT in the current frame are substantially the same as the input image data IDAT in the previous frame. In some example embodiments, to compare the input image data IDAT in the previous frame and the input image data IDAT in the current frame, the still image detector 150 may calculate a representative value (e.g., an average value, a checksum, etc.) of the input image data IDAT in the previous frame and a representative value of the input image data IDAT in the current frame that corresponds to the representative value of the input image data IDAT in the previous frame and compare the representative values.

The driving frequency changer 160 may selectively output the input image data IDAT as the output image data ODAT according to whether the input image data IDAT represent a still image. In a case where the still image detector 160 determines that the input image data IDAT do not represent a still image, the driving frequency changer 160 may output the input image data IDAT as the output image data ODAT. For example, in a case where the input image data IDAT are received at the input frame frequency IFF of 60 Hz (i.e., the input image data IDAT are received at sixty frames per second), and the input image data IDAT do not represent a still image, the driving frequency changer 160 may output the output image data ODAT at the first output frame frequency OFF1 of 60 Hz that is equal to or substantially the same as the input frame frequency IFF. In this case, the data driver 120 may receive the output image data ODAT of the sixty frames per second and drive the display panel 110 at the first output frame frequency OFF1 of 60 Hz based on the output image data ODAT. Further, the controller 140 may provide the scan driver 130 with the scan start signal at the output frame frequency OFF1 of 60 Hz, and the scan driver 130 may perform a scan operation sixty times per second in response to the scan start signal. In some example embodiments, the controller 140 may perform data processing on the output image data ODAT that are output from the driving frequency changer 160, and the output image data ODAT on which the data processing is performed may be provided to the data driver 120. For example, the data processing performed by the controller 140 may include, but not be limited to, pentile data conversion that converts the RGB image data into image data suitable for a pentile pixel arrangement, luminance compensation, color correction, etc.

In a case where the still image detector 160 determines that the input image data IDAT represent a still image, the driving frequency changer 160 may output a portion of the plurality of frames included in the input image data IDAT as the output image data ODAT. For example, in a case where the input image data IDAT are received at the input frame frequency IFF of 60 Hz (i.e., the input image data IDAT of the sixty frames per second are received), and the input image data IDAT represent a still image, the driving frequency changer 160 may output, as the output image data ODAT, the input image data IDAT at one frame per second by selecting one image frame among the sixty frames per second such that the output image data ODAT are output at the second output frame frequency OFF2 of 1 Hz that is lower than the input frame frequency IFF. The data driver 120 may receive the output image data ODAT at one frame per second and drive the display panel 110 at the second output frame frequency OFF2 of 1 Hz based on the output image data ODAT of the one frame per second. Further, the controller 140 may provide the scan start signal at the second output frame frequency OFF2 of 1 Hz to the scan driver 130, and the scan driver 130 may perform the scan operation once per second in response to the scan start signal. Although an example where the second output frame frequency OFF2 is 1 Hz is described above, the second output frame frequency OFF2 may be any frequency that is lower than the input frame frequency IFF and determined by two or more flicker indexes for at least two of primary colors (e.g., the red, green and blue colors) and combinations of the primary colors (e.g., the yellow, magenta and cyan colors) of the still image.

For example, to determine the second output frame frequency OFF2, the driving frequency changer 160 may calculate the red flicker index of the still image based on the red image data included in the input image data IDAT, the green flicker index of the still image based on the green image data included in the input image data IDAT, and the blue flicker index of the still image based on the blue image data included in the input image data IDAT. The input image data IDAT may be RGB image data. In this case, the driving frequency changer 160 may further convert the RGB image data into CMYK image data and calculate the yellow flicker index of the still image based on yellow image data included in the CMYK image data, the magenta flicker index of the still image based on magenta image data included in the CMYK image data, and the cyan flicker index of the still image based on cyan image data included in the CMYK image data. Further, the driving frequency changer 160 may determine a plurality of driving frequencies respectively corresponding to the red, green, blue, yellow, magenta, and cyan flicker indexes and determine the second output frame frequency OFF2 as the maximum frequency of the plurality of driving frequencies. That is, the second output frame frequency OFF2 may be determined based on the flicker indexes for the primary colors and/or the combinations of the primary colors of the still image.

In a conventional display device, a single flicker index corresponding to a single luminance value of an entire image data (e.g., a luminance value represented by luminance data where red image data, green image data, and blue image data are weighted-summed at 2:7:1) of the still image, and a low driving frequency (or the second output frame frequency OFF2) for the still image may be determined according to the single flicker index. Accordingly, with respect to different still images having the same luminance value, although luminances for respective colors are different in the different still images, the conventional display device may operate at the same single low driving frequency. However, as described above, in the OLED display device 100, the low driving frequency, or the second output frame frequency OFF2 may be determined based on two or more of the plurality of flicker indexes for the primary colors and/or the combinations of the primary colors of the still image. Accordingly, the OLED display device 100 may operate at different low driving frequencies with respect to different still images that may have different luminances for each color even if those still images may have the same luminance value as a whole, thereby minimizing or eliminating a flicker that may be perceived by a viewer while reducing the power consumption.

Hereinafter, an operation of the OLED display device 100 according to an example embodiment will be described below with reference to FIGS. 1, and 4 through 6.

Figure 4:
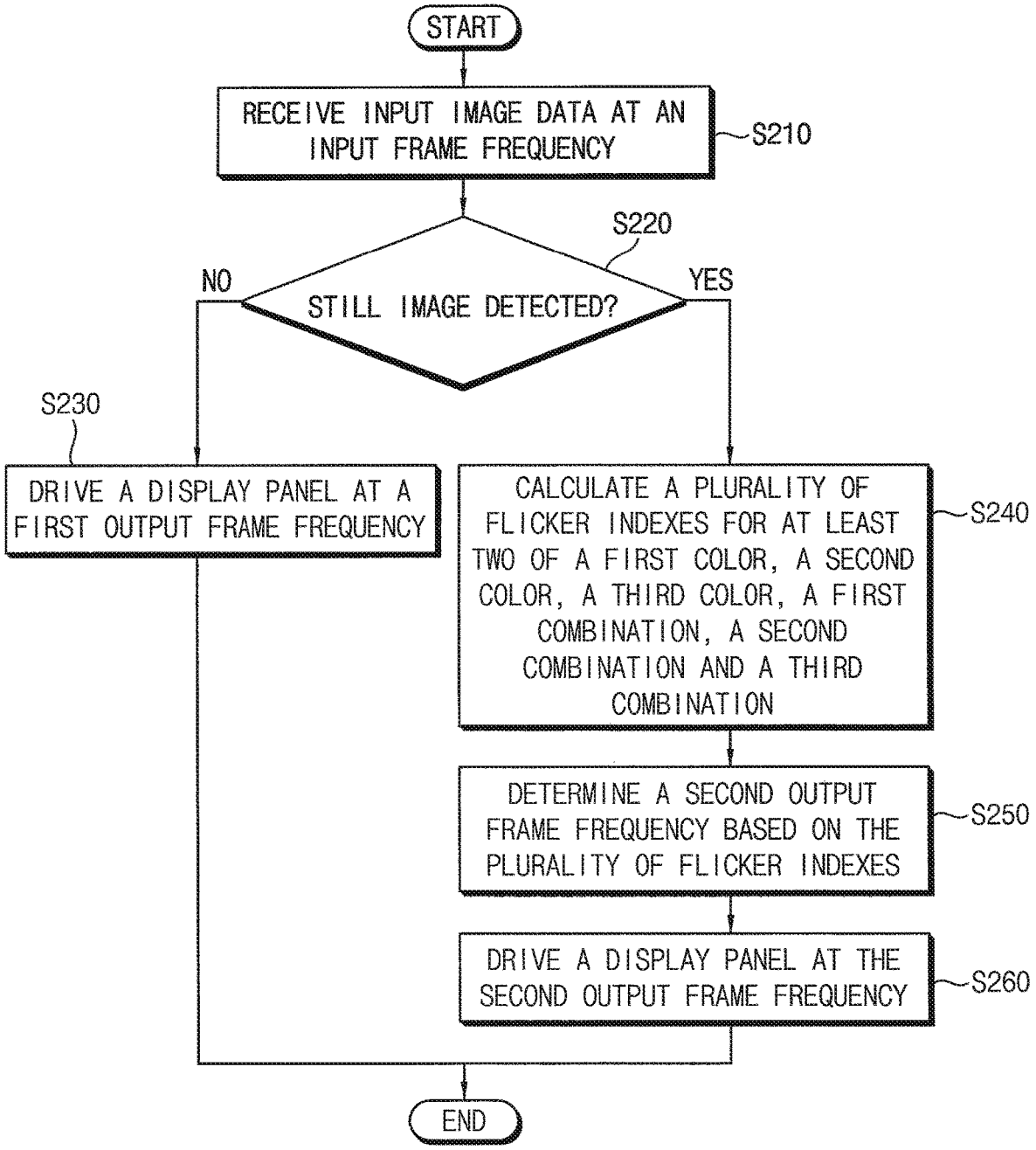
FIG. 4 is a flowchart illustrating a method of operating an OLED display device according to an example embodiment.
Figure 5:
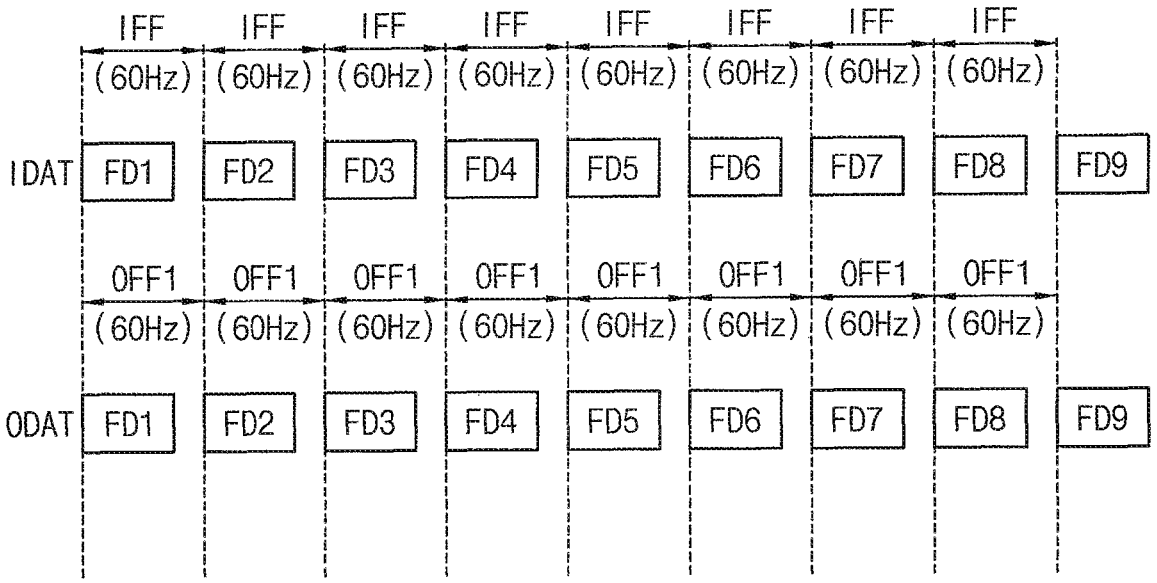
FIG. 5 is a timing diagram illustrating input image data and output image data in a case where a still image is not detected.
Figure 6:
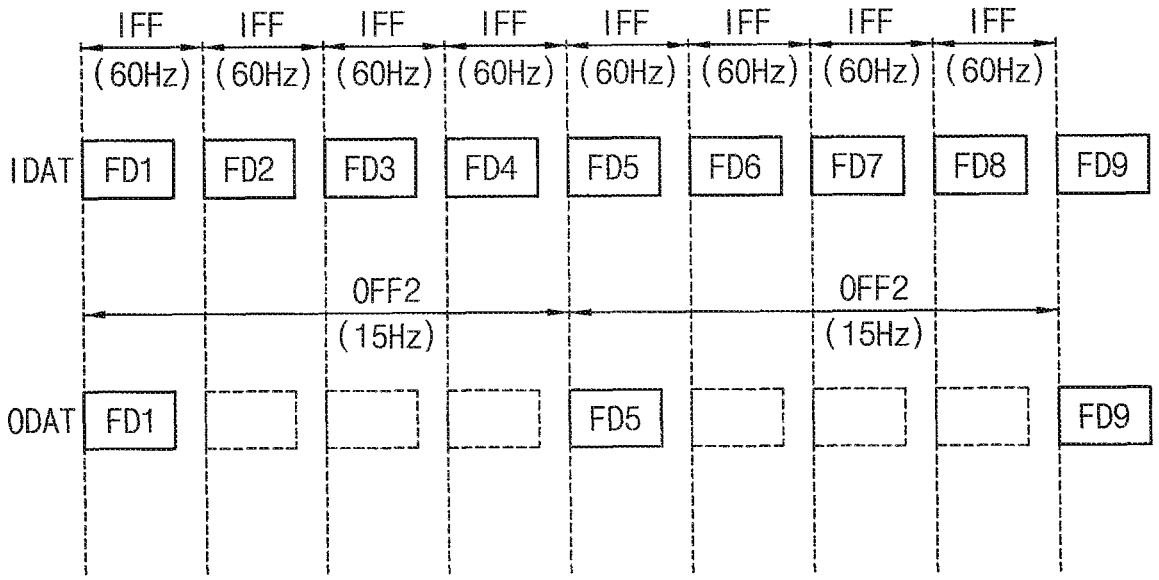
FIG. 6 is a timing diagram illustrating input image data and output image data in a case where a still image is detected.

FIG. 4 is a flowchart illustrating a method of operating an OLED display device according to an example embodiment, FIG. 5 is a timing diagram illustrating input image data and output image data in a case where a still image is not detected, and FIG. 6 is a timing diagram illustrating input image data and output image data in a case where a still image is detected.

Referring to FIGS. 1 and 4, the OLED display device 100 may receive the input image data IDAT including the first image data for the first color, the second image data for the second color, and the third image data for the third color at the input frame frequency IFF (S210). In some example embodiments, the input frame frequency IFF may be a constant frequency or a fixed frequency. For example, the input frame frequency IFF may be, but not be limited to, 60 Hz or 120 Hz. Further, the input image data IDAT may be RGB image data, the first color may be a red color, the second color may be a green color, and the third color may be a blue color.

The still image detector 150 may detect whether the input image data IDAT represent a still image (S220). In some example embodiments, the still image detector 150 may compare the input image data IDAT in a previous frame and the input image data IDAT in a current frame and determine that the input image data IDAT represent a still image if the input image data IDAT in the current frame are equal to or substantially the same as the input image data IDAT in the previous frame.

In a case where the input image data IDAT do not represent a still image (S220: NO), the panel driver 170 may drive the display panel 110 at the first output frame frequency OFF1 that is equal to or substantially the same as the input frame frequency IFF (S230). In this case, the controller 140 may output the input image data IDAT as output image data ODAT. Referring to FIG. 5, in a case where first through ninth frame data FD1 through FD9 are received as the input image data IDAT at the input frame frequency IFF of 60 Hz, the controller 140 may output the first through ninth frame data FD1 through FD9 as the output image data ODAT such that the output image data ODAT are output at the first output frame frequency OFF1 of 60 Hz based on the first through ninth frame data FD1 through FD9.

In a case where the input image data IDAT represent a still image (S220: YES), the driving frequency changer 160 may calculate a plurality of flicker indexes of the still image for at least two of the first color, the second color, the third color, a first combination of the first color and the second color, a second combination of the first color and the third color, and a third combination of the second color and the third color based on the input image data IDAT (S240). In some example embodiments, the first color may be a red color, the second color may be a green color, the third color may be a blue color, the first combination may be a yellow color, the second combination may be a magenta color, the third combination may be a cyan color. The plurality of flicker indexes of the still image may include at least two of a red flicker index, a green flicker index, a blue flicker index, a yellow flicker index, a magenta flicker index, and a cyan flicker index of the still image.

Further, the driving frequency changer 160 may determine the second output frame frequency OFF2 based on the plurality of flicker indexes (S250). In some example embodiments, the driving frequency changer 160 may determine a plurality of driving frequencies respectively corresponding to the red flicker index, the green flicker index, the blue flicker index, the yellow flicker index, the magenta flicker index, and the cyan flicker index and determine the second output frame frequency OFF2 as the maximum frequency of the plurality of driving frequencies. Further, in some example embodiments, the second output frame frequency OFF2 may be lower than the input frame frequency IFF.

The panel driver 170 may drive the display panel 110 at the second output frame frequency OFF2 that is lower than the input frame frequency IFF (S260). In some example embodiments, the controller 140 may output, having a plurality of frames, a portion of the plurality of frames included in the input image data IDAT as the output image data ODAT. Referring to FIG. 6, in a case where the first through ninth frame data FD1 through FD9 are received as the input image data IDAT at the input frame frequency IFF of 60 Hz, the controller 140 may output, as the output image data ODAT, only the first, fifth, and ninth frame data FD1, FD5, and FD9 among the first through ninth frame data FD1 through FD9 such that the output image data ODAT are output at the second output frame frequency OFF2 of 15 Hz that is lower than the input frame frequency IFF of 60 Hz. The data driver 120 may receive the first, fifth, and ninth frame data FD1, FD5, and FD9 as the output image data ODAT and drive the display panel 110 at the second output frame frequency OFF2 of 15 Hz based on the first, fifth, and ninth frame data FD1, FD5, and FD9. Although FIG. 6 illustrates an example where the second output frame frequency OFF2 is 15 Hz, the second output frame frequency OFF2 may be any frequency lower than the input frame frequency IFF and determined by a plurality of flicker indexes for at least two or more of primary colors (e.g., the red, green and blue colors) and combinations of the primary colors (e.g., the yellow, magenta and cyan colors) of the still image.

Figure 7:
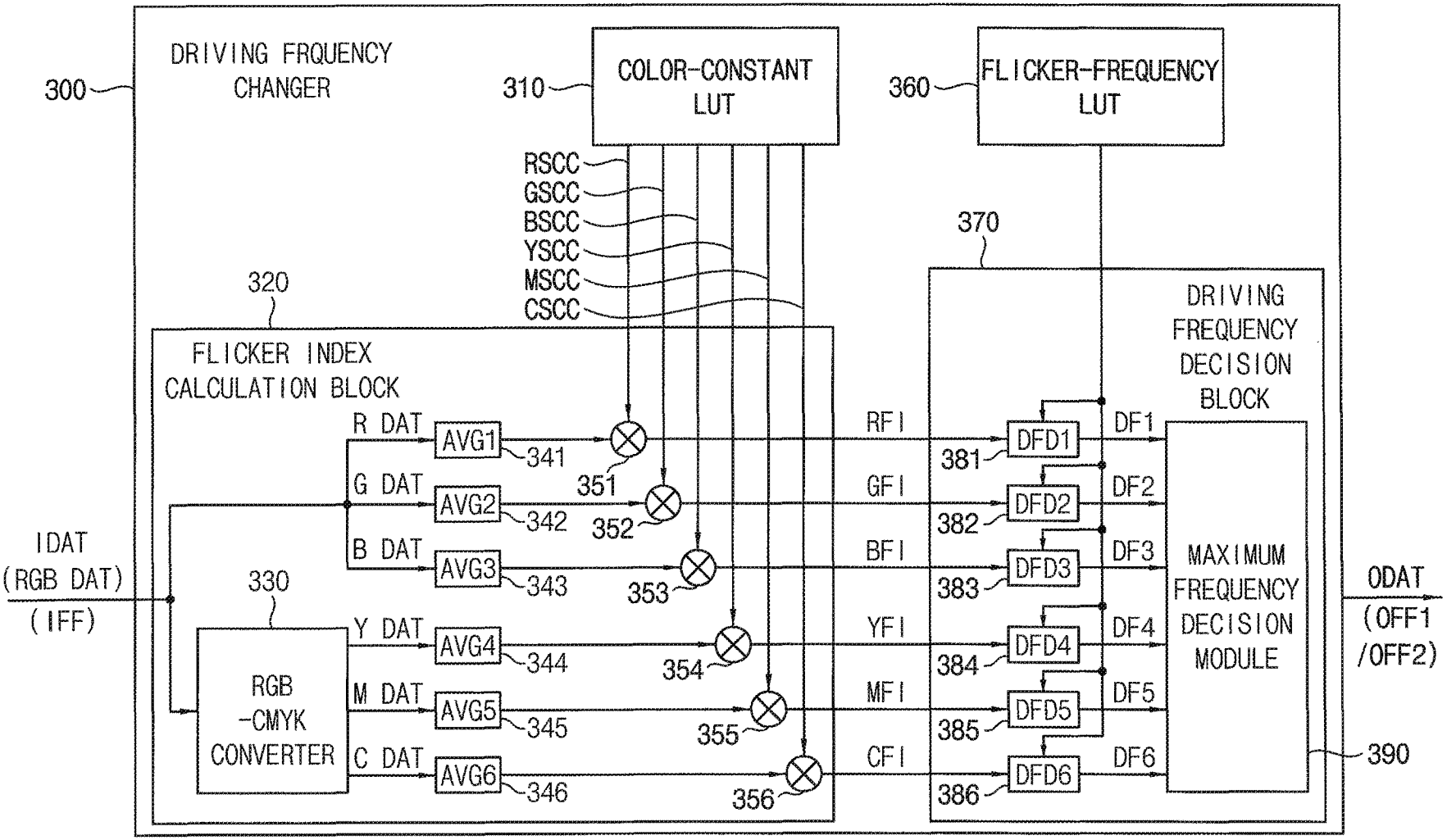
FIG. 7 is a block diagram illustrating a driving frequency changer included in an OLED display device according to an example embodiment.
Figure 11:
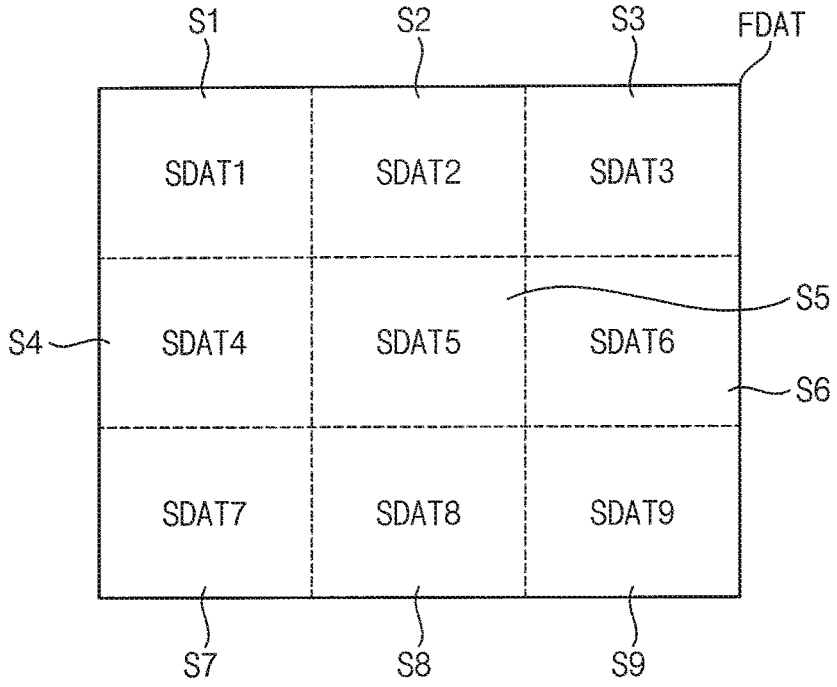
FIG. 11 is a diagram for describing an example where input image data for one frame are divided into a plurality of segment image data for a plurality of segments.
Figure 12:
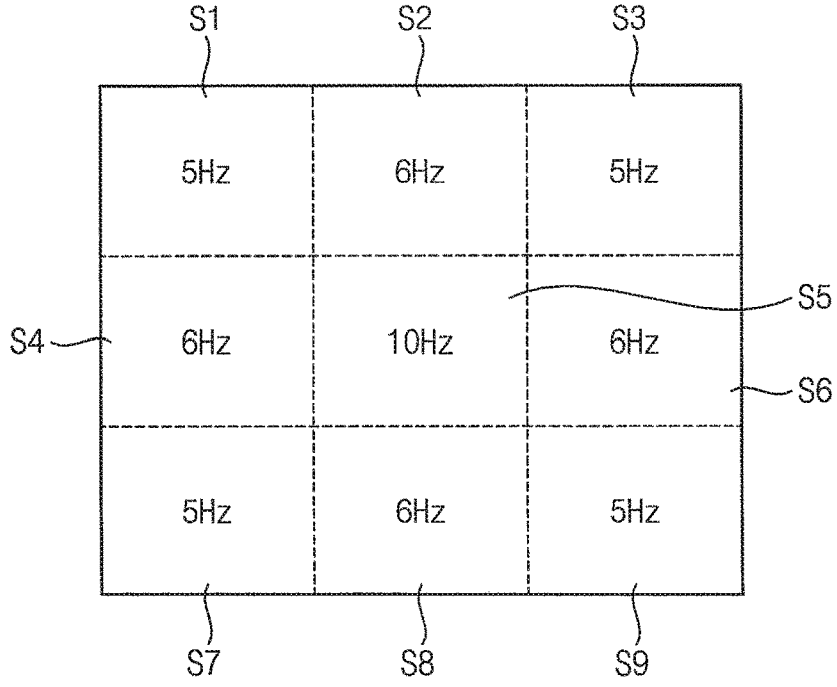
FIG. 12 is a diagram for describing an example of a plurality of segment maximum driving frequencies at a plurality of segments.

FIG. 7 is a block diagram illustrating a driving frequency changer included in an OLED display device according to an example embodiment, FIG. 8 is a diagram illustrating an example of a color-constant lookup table, FIG. 9 is a diagram illustrating another example of a color-constant lookup table, FIG. 10 is a diagram illustrating an example of a flicker-frequency lookup table, FIG. 11 is a diagram for describing an example where input image data for one frame are divided into a plurality of segment image data for a plurality of segments, and FIG. 12 is a diagram for describing an example of a plurality of segment maximum driving frequencies at a plurality of segments.

Referring to FIGS. 1 and 7, the OLED display device 100 may receive input image data IDAT at the input frame frequency IFF. In some example embodiments, the input image data IDAT may be RGB image data. The still image detector 150 may detect whether the input image data IDAT represent a still image. In a case where the input image data IDAT do not represent a still image, a panel driver 170 may drive the display panel 110 at the first output frame frequency OFF1 that is equal to or substantially the same as the input frame frequency IFF.

In a case where the input image data IDAT represent a still image, the driving frequency changer 160 shown in FIG. 1 (or the driving frequency changer 300 shown in FIG. 7) may calculate a plurality of flicker indexes of the still image for primary colors (e.g., red, green and blue colors) and combinations of the primary colors (e.g., yellow, magenta and cyan colors) of the still image and determine the second output frame frequency OFF2 based on the plurality of flicker indexes. The driving frequency changer 160 or 300 may output the output image data ODAT at the second output frame frequency OFF2, and the data driver 120 may provide data signals DS to the plurality of pixels PX based on the output image data ODAT. To determine the second output frame frequency OFF2 based on the plurality of flicker indexes for the primary colors and the combinations thereof, as illustrated in FIG. 7, the driving frequency changer 160 or 300 may include a color-constant lookup table 310, a flicker index calculation block 320, a flicker-frequency lookup table 360, and a driving frequency decision block 370.

The color-constant lookup table 310 may store first through sixth sensitivity correlation constants including, but not limited to, a red sensitivity correlation constant RSCC, a green sensitivity correlation constant GSCC, a blue sensitivity correlation constant BSCC, a yellow sensitivity correlation constant YSCC, a magenta sensitivity correlation constant MSCC, and a cyan sensitivity correlation constant CSCC respectively corresponding to the first color, the second color, the third color, the first combination of the first and second colors, the second combination of the first and third colors, and the third combination of the second and third colors. The respective sensitivity correlation constants RSCC, GSCC, BSCC, YSCC, MSCC, and CSCC may be determined according to flicker perception levels of images of the corresponding primary colors and combinations of the primary colors. For example, even if a green image and another color image have substantially the same luminance, a viewer may perceive a flicker in the green image more severely than in the another color image. Thus, in one example embodiment, the green sensitivity correlation constant GSCC for the green color may be higher than other sensitivity correlation constants including, but not limited to, the green sensitivity correlation constant RSCC, the blue sensitivity correlation constant BSCC, the yellow sensitivity correlation constant YSCC, the magenta sensitivity correlation constant MSCC, and the cyan sensitivity correlation constant CSCC.

In some example embodiments, the color-constant lookup table 310 may store the red, green, blue, yellow, magenta, and cyan sensitivity correlation constants RSCC, GSCC, BSCC, YSCC, MSCC and CSCC for the red, green, blue, yellow, magenta and cyan colors. Referring to FIG. 8, a color-constant lookup table 310*a*, as an example of the color-constant lookup table 310 of FIG. 7, may store the red sensitivity correlation constant RSCC of 0.2, the green sensitivity correlation constant GSCC of 1.0, the blue sensitivity correlation constant BSCC of 0.5, the yellow sensitivity correlation constant YSCC of 0.9, the magenta sensitivity correlation constant MSCC of 0.6, and the cyan sensitivity correlation constant CSCC of 0.9. However, it is noted that the sensitivity correlation constants RSCC, GSCC, BSCC, YSCC, MSCC and CSCC may not be limited to the example of FIG. 8, and other sensitivity correlation constant values may be used without deviating from the scope of the present disclosure.

In other example embodiments, the color-constant lookup table 310 may store the red, green, blue, yellow, magenta, and cyan sensitivity correlation constants RSCC, GSCC, BSCC, YSCC, MSCC and CSCC at each of a plurality of gray ranges. Referring to FIG. 9, a color-constant lookup table 310*b*, as an example of the color-constant lookup table 310 of FIG. 7, may store different sensitivity correlation constants RSCC, GSCC, BSCC, YSCC, MSCC, and CSCC based on a gray range. For example, the color-constant lookup table 310*b* may store the red, green, blue, yellow, magenta, and cyan sensitivity correlation constants RSCC, GSCC, BSCC, YSCC, MSCC, and CSCC of (0.2, 0.0, 0.6, 0.9, 0.7, and 0.9) at a first gray range from 1-19, (0.3, 1.2, 0.7, 1.0, 0.8, and 1.0) at a second gray range from 20-29, (0.2, 1.0, 0.5, 0.9, 0.6, and 0.9) at a third gray range from 30-99, (0.1, 0.7, 0.4, 0.8, 0.4, and 0.8) at a fourth gray range from 100-159, and (0.0, 0.5, 0.2, 0.5, 0.4, and 0.5) at a fifth gray range from 160-255. However, it is noted that the sensitivity correlation constants RSCC, GSCC, BSCC, YSCC, MSCC, and CSCC may not be limited to the example of FIG. 9, and other values of the red, green, blue, yellow, magenta, and cyan sensitivity correlation constants RSCC, GSCC, BSCC, YSCC, MSCC, and CSCC in different gray ranges may be used without deviating from the scope of the present disclosure.

The flicker index calculation block 320 may calculate first, second, and third average gray values for the first, second, and third colors based on the input image data IDAT, perform a color conversion operation on the input image data IDAT, calculate fourth, fifth, and sixth average gray values for the first, second, and third combinations based on the input image data IDAT on which the color conversion operation is performed, and calculate first through sixth flicker indexes such as a red flicker index RFI, a green flicker index GFI, a blue flicker index BFI, a yellow flicker index YFI, a magenta flicker index MFI, and a cyan flicker index CFI as the plurality of flicker indexes by multiplying the first through sixth average gray values by the first through sixth sensitivity correlation constants RSCC, GSCC, BSCC, YSCC, MSCC, and CSCC, respectively.

In some example embodiments, to calculate the first through sixth flicker indexes RFI, GFI, BFI, YFI, MFI, and CFI, as illustrated in FIG. 7, the flicker index calculation block 320 may include an RGB-CMYK converter 330, first through sixth average calculators 341, 342, 343, 344, 345, and 346 and first through sixth multipliers 351, 352, 353, 354, 355, and 356.

The first average calculator 341 may calculate, as the first average gray value, an average value of gray levels represented by red image data R DAT included in the input image data IDAT, or the RGB image data RGB DAT. The second average calculator 342 may calculate, as the second average gray value, an average value of gray levels represented by green image data G DAT included in the RGB image data RGB DAT. The third average calculator 343 may calculate, as the third average gray value, an average value of gray levels represented by blue image data B DAT included in the RGB image data RGB DAT.

The RGB-CMYK converter 330 may perform an RGB-CMYK conversion operation that converts the RGB image data RGB DAT into CMYK image data. For example, the RGB-CMYK converter 330 may perform the RGB-CMYK conversion operation by using equations, "K=255−max(R, G, B)," "C=(255−K−R)/(255−K)," "M=(255−K−G)/(255−K)," and "Y=(255−K−B)/(255−K)," where R represent the red image data R DAT, G represents the green image data G DAT, B represents the blue image data B DAT, K represents black image data, C represents cyan image data C DAT, M represents magenta image data M DAT, and Y represents yellow image data Y DAT.

The fourth average calculator 344 may calculate, as the fourth average gray value, an average value of gray levels represented by the yellow image data Y DAT included in the CMYK image data. The fifth average calculator 345 may calculate, as the fifth average gray value, an average value of gray levels represented by the magenta image data M DAT included in the CMYK image data. The sixth average calculator 346 may calculate, as the sixth average gray value, an average value of gray levels represented by the cyan image data C DAT included in the CMYK image data.

The red sensitivity correlation constant RSCC may be read from the color-constant lookup table 310, and the first multiplier 351 may calculate, as the first flicker index, the red flicker index RFI by multiplying the first average gray value by the red sensitivity correlation constant RSCC. The green sensitivity correlation constant GSCC may be read from the color-constant lookup table 310, and the second multiplier 352 may calculate, as the second flicker index, the green flicker index GFI by multiplying the second average gray value by the green sensitivity correlation constant GSCC. The blue sensitivity correlation constant BSCC may be read from the color-constant lookup table 310, and the third multiplier 353 may calculate, as the third flicker index, the blue flicker index BFI by multiplying the third average gray value by the blue sensitivity correlation constant BSCC. The yellow sensitivity correlation constant YSCC may be read from the color-constant lookup table 310, and the fourth multiplier 354 may calculate, as the fourth flicker index, the yellow flicker index YFI by multiplying the fourth average gray value by the yellow sensitivity correlation constant YSCC. The magenta sensitivity correlation constant MSCC may be read from the color-constant lookup table 310, and the fifth multiplier 355 may calculate, as the fifth flicker index, the magenta flicker index MFI by multiplying the fifth average gray value by the magenta sensitivity correlation constant MSCC. The cyan sensitivity correlation constant CSCC may be read from the color-constant lookup table 310, and the sixth multiplier 356 may calculate, as the sixth flicker index, the cyan flicker index CFI by multiplying the sixth average gray value by the cyan sensitivity correlation constant CSCC.

In a case where the color-constant lookup table 310*b* stores the red, green, blue, yellow, magenta, and cyan sensitivity correlation constants RSCC, GSCC, BSCC, YSCC, MSCC, and CSCC at each of the plurality of gray ranges, as illustrated in FIG. 9, the flicker index calculation block 320 may receive the red, green, blue, yellow, magenta, and cyan sensitivity correlation constants RSCC, GSCC, BSCC, YSCC, MSCC, and CSCC from the color-constant lookup table 310*b* that correspond to the first through sixth average gray values and calculate the red, green, blue, yellow, magenta, and cyan flicker indexes RFI, GFI, BFI, YFI, MFI, and CFI by multiplying the first through sixth average gray values by the red, green, blue, yellow, magenta, and cyan sensitivity correlation constants RSCC, GSCC, BSCC, YSCC, MSCC, and CSCC, respectively.

The flicker-frequency lookup table 360 may store a plurality of driving frequencies respectively corresponding to a plurality of flicker index ranges. Referring to FIG. 10, a flicker-frequency lookup table 360*a* may store the plurality of flicker index ranges FIR1, FIR2, FIR3, FIR4, FIR5, FIR6, FIR7, and FIR8, and the plurality of driving frequencies DFA, DFB, DFC, DFD, DFE, DFF, DFG, and DFH respectively corresponding to the plurality of flicker index ranges FIR1, FIR2, FIR3, FIR4, FIR5, FIR6, FIR7, and FIR8. Although FIG. 10 illustrates an example where the flicker-frequency lookup table 360*a* stores eight driving frequencies DFA through DFH at eight flicker index ranges FIR1 through FIR8, the number of the flicker index ranges FIR1 through FIR8 in the flicker-frequency lookup table 360 may not be limited to eight.

The driving frequency decision block 370 may read first through sixth driving frequencies DF1, DF2, DF3, DF4, DF5 and DF6 respectively corresponding to the first through sixth flicker indexes RFI, GFI, BFI, YFI, MFI, and CFI from the flicker-frequency lookup table 360, determine the second output frame frequency OFF2 as the maximum frequency of the first through sixth driving frequencies DF1, DF2, DF3, DF4, DF5, and DF6, and output the output image data ODAT at the second output frame frequency OFF2. To perform these operations, in some example embodiments, as illustrated in FIG. 7, the driving frequency decision block 370 may include first through sixth driving frequency decision modules 381, 382, 383, 384, 385, and 386 and a maximum frequency decision module 390.

The first driving frequency decision module 381 may read the first driving frequency DF1 corresponding to the red flicker index RFI from the flicker-frequency lookup table 360 and output the first driving frequency DF1. The second driving frequency decision module 382 may read the second driving frequency DF2 corresponding to the green flicker index GFI from the flicker-frequency lookup table 360 and output the second driving frequency DF2. The third driving frequency decision module 383 may read the third driving frequency DF3 corresponding to the blue flicker index BFI from the flicker-frequency lookup table 360 and output the third driving frequency DF3. The fourth driving frequency decision module 384 may read the fourth driving frequency DF4 corresponding to the yellow flicker index YFI from the flicker-frequency lookup table 360 and output the fourth driving frequency DF4. The fifth driving frequency decision module 385 may read the fifth driving frequency DF5 corresponding to the magenta flicker index MFI from the flicker-frequency lookup table 360 and output the fifth driving frequency DF5. The sixth driving frequency decision module 386 may read the sixth driving frequency DF6 corresponding to the cyan flicker index CFI from the flicker-frequency lookup table 360 and output the sixth driving frequency DF6. The maximum frequency decision module 390 may determine the second output frame frequency OFF2 as the maximum frequency of the first through sixth driving frequencies DF1, DF2, DF3, DF4, DF5, and DF6 that are output from the first through sixth driving frequency decision modules 381, 382, 383, 384, 385, and 386, respectively. The driving frequency decision block 370 may output the output image data ODAT at the second output frame frequency OFF2 that is determined by the maximum frequency decision module 390.

In some example embodiments, calculating the first through sixth flicker indexes RFI, GFI, BFI, YFI, MFI, and CFI, and determining the first through sixth driving frequencies DF1, DF2, DF3, DF4, DF5, and DF6, as described above, may be performed on a segment-by-segment basis. Referring to FIG. 11, the flicker index calculation block 320 may divide frame image data FDAT (or a single frame image data of the input image data IDAT) into a plurality of segment image data SDAT1, SDAT2, SDAT3, SDAT4, SDAT5, SDAT6, SDAT7, SDAT8, and SDAT9 corresponding to a plurality of segments S1, S2, S3, S4, S5, S6, S7, S8, and S9. Further, the flicker index calculation block 320 may calculate the first through sixth average gray values at each segment of the plurality of segments S1 through S9 based on corresponding segment image data SDAT1 through SDAT9 and calculate the first through sixth flicker indexes RFI, GFI, BFI, YFI, MFI, and CFI corresponding to each segment of the plurality of segments S1 through S9 by multiplying the first through sixth average gray values for each segment of the plurality of segments S1 through S9 by the first through sixth sensitivity correlation constants RSCC, GSCC, BSCC, YSCC, MSCC, and CSCC, respectively. The driving frequency decision block 370 may read the first through sixth driving frequencies DF1 through DF6 at each segment of the plurality of segments S1 through S9 respectively corresponding to the first through sixth flicker indexes RFI, GFI, BFI, YFI, MFI, and CFI at each segment of the plurality of segments S1 through S9 from the flicker-frequency lookup table 360 and determine a segment maximum driving frequency at each segment of the plurality of segments S1 through S9 as the maximum frequency of the first through sixth driving frequencies DF1 through DF6. In some example embodiments, the driving frequency decision block 370 may determine a plurality of segment maximum driving frequencies corresponding to the plurality of segments S1 through S9. Further, the driving frequency decision block 370 may determine the second output frame frequency OFF2 as the maximum frequency of the plurality of segment maximum driving frequencies at the plurality of segments S1 through S9. Referring to FIG. 12, in a case where the plurality of segment maximum driving frequencies at the plurality of segments S1 through S9 range from 5 Hz to 10 Hz, the driving frequency decision block 370 may determine the second output frame frequency OFF2 as 10 Hz that is the segment maximum driving frequency at the fifth segment S5.

Hereinafter, an operation of the OLED display device 100 according to an example embodiment will be described below with reference to FIGS. 1, 7 and 13.

Figure 13:
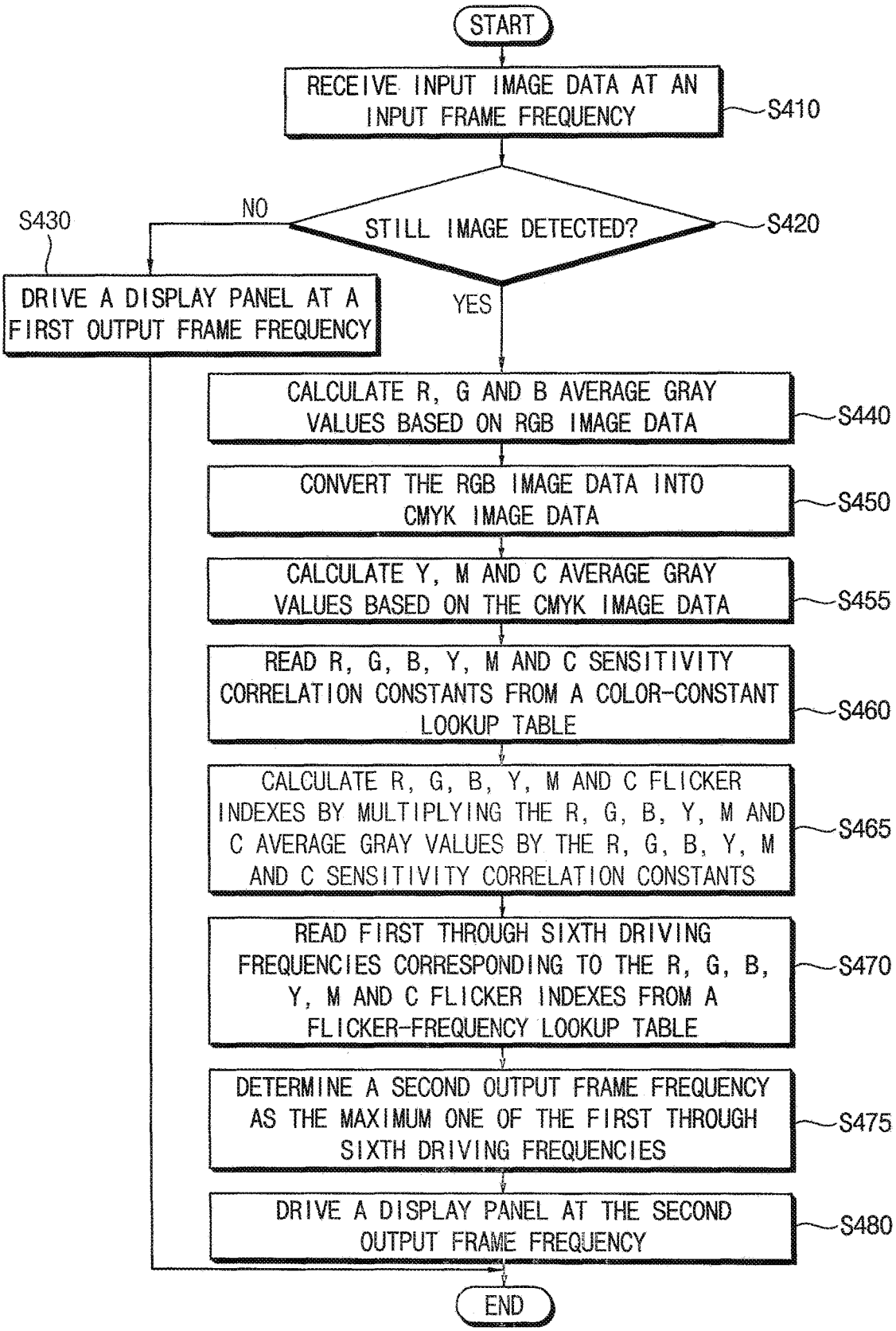
FIG. 13 is a flowchart illustrating a method of operating an OLED display device according to an example embodiment.

FIG. 13 is a flowchart illustrating a method of operating an OLED display device according to an example embodiment.

Referring to FIGS. 1, 7 and 13, the OLED display device 100 may receive the input image data IDAT as the RGB image data RGB DAT at the input frame frequency IFF (S410). The still image detector 150 may detect whether the input image data IDAT represent a still image (S420). In a case where the input image data IDAT do not represent a still image (S420: NO), the panel driver 170 may drive the display panel 110 at the first output frame frequency OFF1 that is equal to or substantially the same as the input frame frequency IFF (S430).

In a case where the input image data IDAT represent a still image (S420: YES), the first, second, and third average calculators 341, 342, and 343 of the flicker index calculation block 320 may calculate first, second, and third average gray values for red, green, and blue colors based on the RGB image data RGB DAT (S440). The RGB-CMYK converter 330 may perform an RGB-CMYK conversion operation on the RGB image data RGB DAT to generate CMYK image data (S450). The fourth, fifth, and sixth average calculators 344, 345 and 346 may calculate fourth, fifth, and sixth average gray values for yellow, magenta, and cyan colors based on the CMYK image data (S455). The flicker index calculation block 320 may read red, green, blue, yellow, magenta, and cyan sensitivity correlation constants RSCC, GSCC, BSCC, YSCC, MSCC, and CSCC from the color-constant lookup table 310 (S460). The first through sixth multipliers 351, 352, 353, 354, 355, and 356 may calculate the red, green, blue, yellow, magenta and cyan flicker indexes RFI, GFI, BFI, YFI, MFI, and CFI by multiplying the first through sixth average gray values by the red, green, blue, yellow, magenta, and cyan sensitivity correlation constants RSCC, GSCC, BSCC, YSCC, MSCC, and CSCC, respectively (S465). The first through sixth driving frequency decision modules 381, 382, 383, 384, 385, and 386 of the driving frequency decision block 370 may read the first through sixth driving frequencies DF1, DF2, DF3, DF4, DF5, and DF6 respectively corresponding to the red, green, blue, yellow, magenta, and cyan flicker indexes RFI, GFI, BFI, YFI, MFI, and CFI from the flicker-frequency lookup table 360 (S470). The maximum frequency decision module 390 may determine the second output frame frequency OFF2 as the maximum frequency of the first through sixth driving frequencies DF1, DF2, DF3, DF4, DF5, and DF6 (S475). The panel driver 170 may drive the display panel 110 at the second output frame frequency OFF2 that is determined by the maximum frequency decision module 390 (S480).

Figure 14:
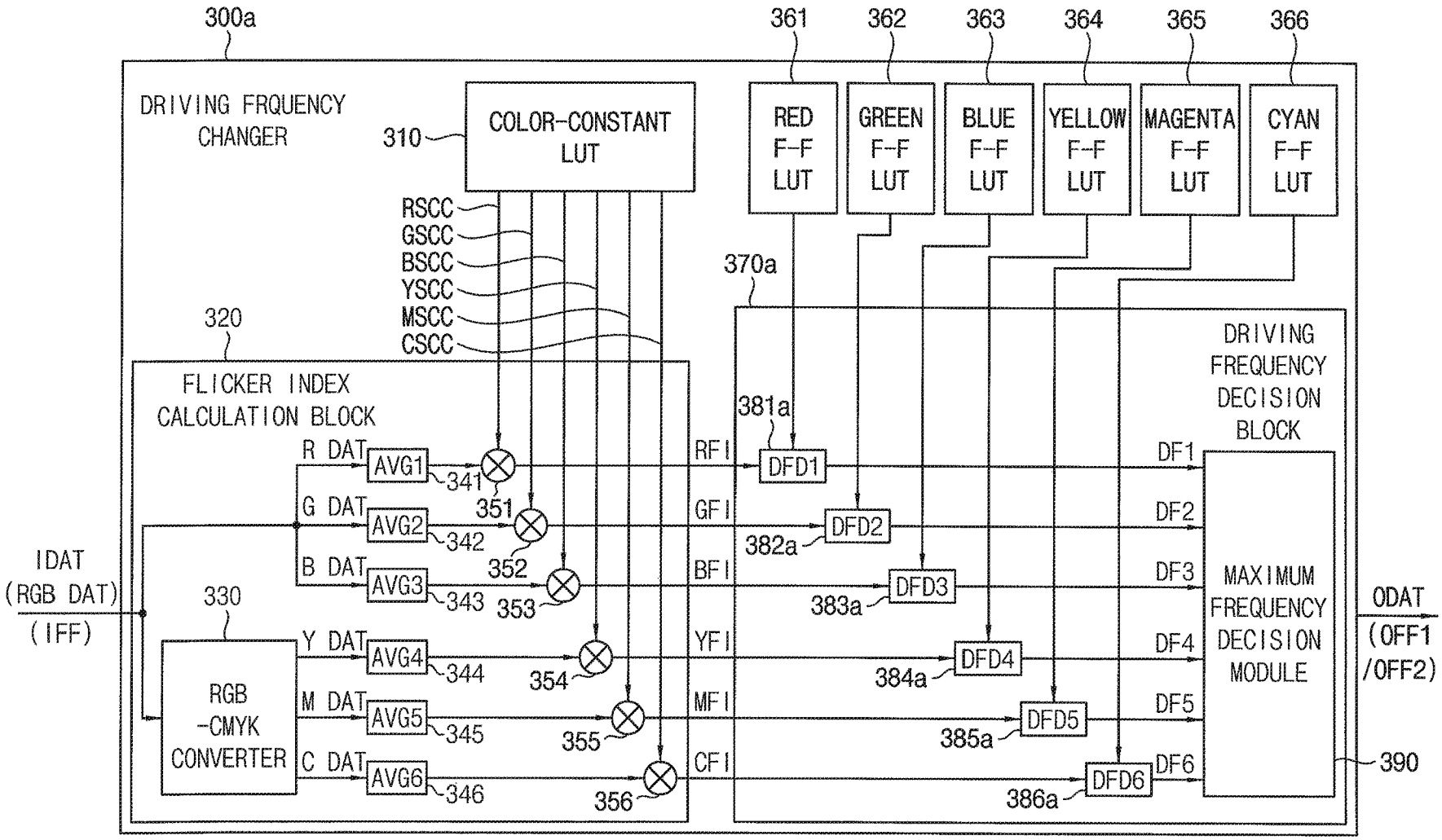
FIG. 14 is a block diagram illustrating a driving frequency changer included in an OLED display device according to an example embodiment.

FIG. 14 is a block diagram illustrating a driving frequency changer included in an OLED display device according to an example embodiment.

Referring to FIG. 14, a driving frequency changer 300*a* may include the color-constant lookup table 310, the flicker index calculation block 320, a red flicker-frequency lookup table 361, a green flicker-frequency lookup table 362, a blue flicker-frequency lookup table 363, a yellow flicker-frequency lookup table 364, a magenta flicker-frequency lookup table 365, a cyan flicker-frequency lookup table 366, and a driving frequency decision block 370*a*. The driving frequency changer 300*a* of FIG. 14 may have a similar configuration and operation that are comparable to the driving frequency changer 300 of FIG. 7, except that the driving frequency changer 300*a* may include the plurality of flicker-frequency lookup tables 361, 362, 363, 364, 365, and 366 for the respective colors.

Each of the red, green, blue, yellow, magenta, and cyan flicker-frequency lookup tables 361, 362, 363, 364, 365, and 366 may store a plurality of driving frequencies respectively corresponding to a plurality of flicker index ranges. The driving frequency decision block 370*a* may read first through sixth driving frequencies DF1, DF2, DF3, DF4, DF5, and DF6 corresponding to red, green, blue, yellow, magenta, and cyan flicker indexes RFI, GFI, BFI, YFI, MFI, and CFI from the red, green, blue, yellow, magenta, and cyan flicker-frequency lookup tables 361, 362, 363, 364, 365 and 366, respectively. The driving frequency decision block 370*a* may determine the second output frame frequency OFF2 as the maximum frequency of the first through sixth driving frequencies DF1, DF2, DF3, DF4, DF5, and DF6 and output the output image data ODAT at the second output frame frequency OFF2.

For example, a first driving frequency decision module 381*a* may read the first driving frequency DF1 corresponding to the red flicker index RFI from the red flicker-frequency lookup table 361 and output the first driving frequency DF1. A second driving frequency decision module 382*a* may read the second driving frequency DF2 corresponding to the green flicker index GFI from the green flicker-frequency lookup table 362 and output the second driving frequency DF2. A third driving frequency decision module 383*a* may read the third driving frequency DF3 corresponding to the blue flicker index BFI from the blue flicker-frequency lookup table 363 and output the third driving frequency DF3. A fourth driving frequency decision module 384*a* may read the fourth driving frequency DF4 corresponding to the yellow flicker index YFI from the yellow flicker-frequency lookup table 364 and output the fourth driving frequency DF4. A fifth driving frequency decision module 385*a* may read the fifth driving frequency DF5 corresponding to the magenta flicker index MFI from the magenta flicker-frequency lookup table 365 and output the fifth driving frequency DF5. A sixth driving frequency decision module 386*a* may read the sixth driving frequency DF6 corresponding to the cyan flicker index CFI from the cyan flicker-frequency lookup table 366 and output the sixth driving frequency DF6. The maximum frequency decision module 390 may determine the second output frame frequency OFF2 as the maximum frequency of the first through sixth driving frequencies DF1, DF2, DF3, DF4, DF5, and DF6 that are output from the first through sixth driving frequency decision modules 381*a*, 382*a*, 383*a*, 384*a*, 385*a*, and 386*a*. The driving frequency decision block 370*a* may output the output image data ODAT at the second output frame frequency OFF2 that is determined by the maximum frequency decision module 390.

Hereinafter, an operation of the OLED display device 100 according to an example embodiment will be described below with reference to FIGS. 1, 14 and 15.

Figure 15:
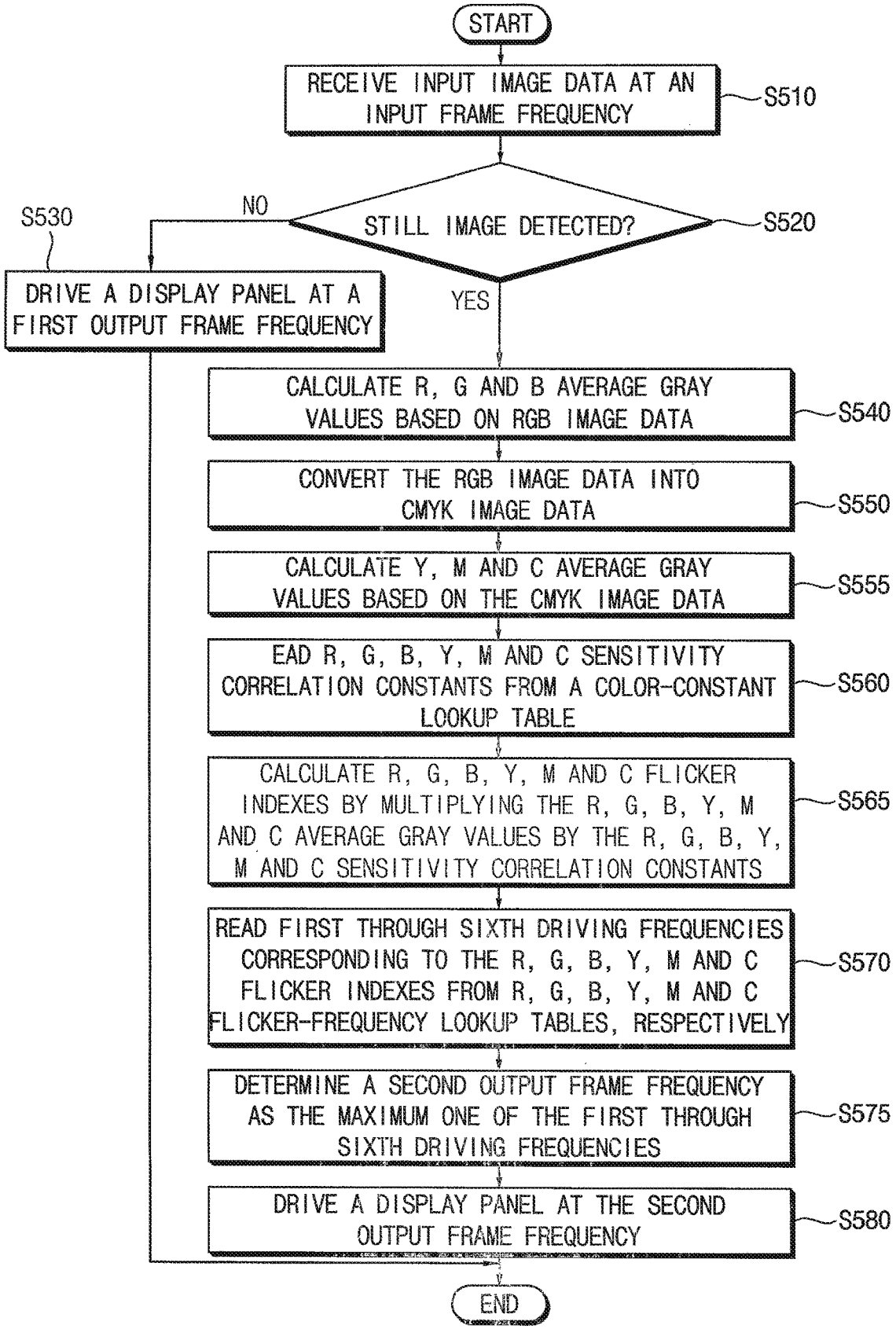
FIG. 15 is a flowchart illustrating a method of operating an OLED display device according to an example embodiment.

FIG. 15 is a flowchart illustrating a method of operating an OLED display device according to an example embodiment.

Referring to FIGS. 1, 14 and 15, the OLED display device 100 may receive the input image data IDAT as the RGB image data RGB DAT at the input frame frequency IFF (S510). The still image detector 150 may detect whether the input image data IDAT represent a still image (S520). In a case where the input image data IDAT do not represent the still image (S520: NO), a panel driver 170 may drive the display panel 110 at a first output frame frequency OFF1 that is equal to or substantially the same as the input frame frequency IFF (S530).

In a case where the input image data IDAT represent the still image (S520: YES), the first, second, and third average calculators 341, 342 and 343 of the flicker index calculation block 320 may calculate first, second, and third average gray values for red, green, and blue colors based on the RGB image data RGB DAT (S540). The RGB-CMYK converter 330 may perform an RGB-CMYK conversion operation on the RGB image data RGB DAT to generate CMYK image data (S550). The fourth, fifth, sixth average calculators 344, 345, and 346 may calculate fourth, fifth, and sixth average gray values for yellow, magenta, and cyan colors based on the CMYK image data (S555). The flicker index calculation block 320 may read red, green, blue, yellow, magenta, and cyan sensitivity correlation constants RSCC, GSCC, BSCC, YSCC, MSCC, and CSCC from the color-constant lookup table 310 (S560). The first through sixth multipliers 351, 352, 353, 354, 355, and 356 may calculate red, green, blue, yellow, magenta, and cyan flicker indexes RFI, GFI, BFI, YFI, MFI, and CFI by multiplying the first through sixth average gray values by the red, green, blue, yellow, magenta, and cyan sensitivity correlation constants RSCC, GSCC, BSCC, YSCC, MSCC, and CSCC, respectively (S565). The first through sixth driving frequency decision modules 381*a*, 382*a*, 383*a*, 384*a*, 385*a*, and 386*a* of the driving frequency decision block 370*a* may read first through sixth driving frequencies DF1, DF2, DF3, DF4, DF5, and DF6 respectively corresponding to the red, green, blue, yellow, magenta, and cyan flicker indexes RFI, GFI, BFI, YFI, MFI, and CFI from the red, green, blue, yellow, magenta and cyan flicker-frequency lookup tables 361, 362, 363, 364, 365, and 366, respectively (S570). The maximum frequency decision module 390 may determine a second output frame frequency OFF2 as the maximum frequency of the first through sixth driving frequencies DF1, DF2, DF3, DF4, DF5, and DF6 (S575). The panel driver 170 may drive the display panel 110 at the second output frame frequency OFF2 that is determined by the maximum frequency decision module 390 (S580).

Figure 16:
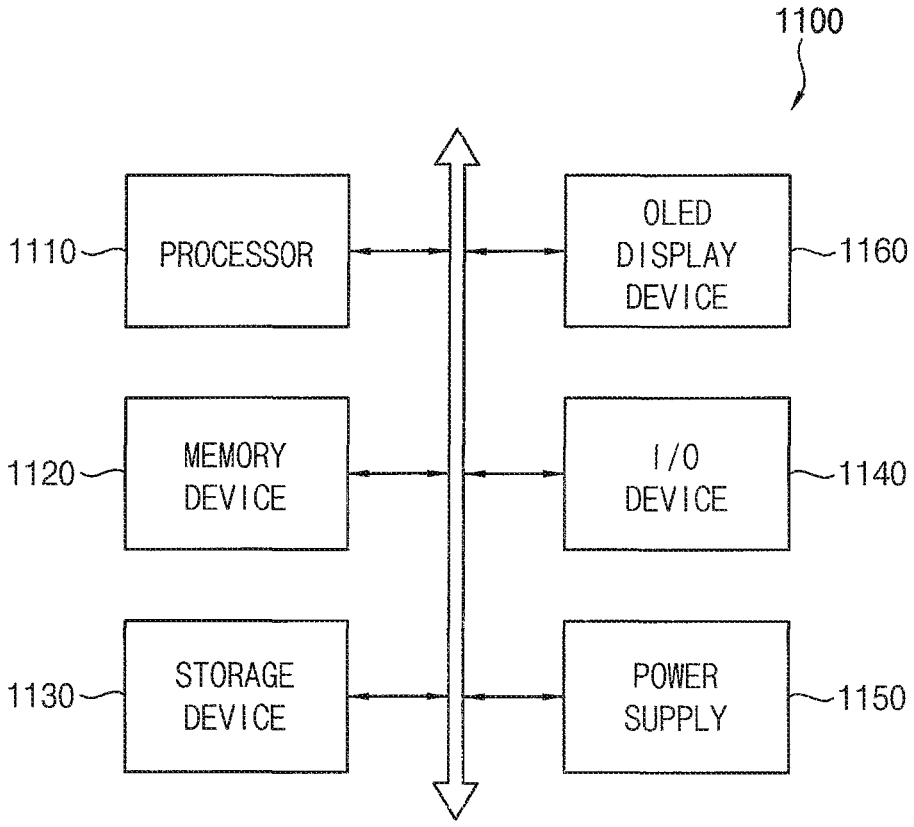
FIG. 16 is an electronic device including a display device according to an example embodiment.

FIG. 16 is an electronic device including a display device according to an example embodiment.

Referring to FIG. 16, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating with various peripheral devices including, but not limited to, a video card, a sound card, a memory card, a universal serial bus (USB) device, and other electric devices.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data and/or instructions for operating the electronic device 1100. For example, the memory device 1120 may include at least one non-volatile memory device such as an erasable programmable read-only memory (EPROM) device, an electrically erasable programmable read-only memory (EEPROM) device, a flash memory device, a phase-change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid-state drive (SSD) device, a hard disk drive (HDD) device, a CD-ROM device, etc. The I/O device 1140 may include an input device such as a keyboard, a keypad, a mouse, a touch screen, etc., and an output device such as a printer, a speaker, etc. The power supply 1150 may supply power for operating the electronic device 1100. The OLED display device 1160 may be coupled to other components through various buses or communication links.

The OLED display device 1160 may determine whether input image data represent a still image. When the input image data represent the still image, the OLED display device 1160 may calculate a plurality of flicker indexes of the still image for at least two of primary colors (e.g., a red color, a green color and a blue color) and combinations of the primary colors (e.g., a yellow color, a magenta color and a cyan color) based on the input image data, determine a second output frame frequency (or a low driving frequency) based on the plurality of flicker indexes and drive a display panel (e.g., the display panel 110 of FIG. 1) at the second output frame frequency. Accordingly, in cases where still images may have substantially the same single luminance, but may have different luminances with respect to each of the respective primary colors and/or combinations of the primary colors, the OLED display device 1160 according to an example embodiment may drive the display panel at different low driving frequencies when displaying the still images based on the different luminances, thereby minimizing or eliminating a flicker that may be perceived by a viewer while reducing the power consumption.

The inventive concepts disclosed herein may be applied to any OLED display device, and any electronic device including the OLED display device. For example, the inventive concepts may be applied to a mobile phone, a smart phone, a wearable electronic device, a tablet computer, a television (TV), a digital TV, a three-dimensional (3D) TV, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although specific example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept disclosed herein. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the present disclosure.

What is claimed is:

1. A display device comprising:

a display panel; and a panel driver configured to drive the display panel, wherein the panel driver receives input image data corresponding to a first color, a second color, and a third color at an input frame frequency, and detects whether the input image data represent a still image or a dynamic image, wherein, in a first case where the input image data represent the dynamic image, the panel driver drives the display panel at a first output frame frequency that is equal to or substantially the same as the input frame frequency, and wherein, in a second case where the input image data represent the still image, the panel driver calculates a plurality of flicker indexes of the still image for at least two of the first color, the second color, the third color, a first combination of the first color and the second color, a second combination of the first color and the third color, and a third combination of the second color and the third color based on the input image data, determines a second output frame frequency based on the plurality of flicker indexes, and drives the display panel at the second output frame frequency.

2. The display device of claim 1, wherein the second output frame frequency is lower than the input frame frequency.

3. The display device of claim 1, wherein the first color is a red color, the second color is a green color, the third color is a blue color, the first combination is a yellow color, the second combination is a magenta color, and the third combination is a cyan color, and wherein the plurality of flicker indexes of the still image include a red flicker index corresponding to the red color, a green flicker index corresponding to the green color, a blue flicker index corresponding to the blue color, a yellow flicker index corresponding to the yellow color, a magenta flicker index corresponding to the magenta color, and a cyan flicker index corresponding to the cyan color.

4. The display device of claim 3, wherein, in the second case where the input image data represent the still image, the panel driver determines a plurality of driving frequencies respectively corresponding to the red flicker index, the green flicker index, the blue flicker index, the yellow flicker index, the magenta flicker index, and the cyan flicker index, and determines the second output frame frequency as a maximum frequency of the plurality of driving frequencies.

5. The display device of claim 1, wherein the display panel includes a plurality of pixels, and each of the plurality of pixels includes:

a driving transistor configured to generate a driving current;

a display element configured to emit light based on the driving current;

a switching transistor configured to transfer a data signal to a source of the driving transistor;

a compensating transistor configured to diode-connect the driving transistor;

a storage capacitor configured to store the data signal transferred through the switching transistor and the driving transistor;

a first initializing transistor configured to provide an initialization voltage to the storage capacitor and a gate of the driving transistor;

a first emission controlling transistor configured to connect a line of a power supply voltage to the source of the driving transistor;

a second emission controlling transistor configured to connect a drain of the driving transistor to the display element; and a second initializing transistor configured to provide the initialization voltage to the display element, and wherein at least first one of the driving transistor, the switching transistor, the compensating transistor, the first initializing transistor, the first emission controlling transistor, the second emission controlling transistor, and the second initializing transistor is implemented with a P-type metal-oxide-semiconductor (PMOS) transistor, and at least second one of the driving transistor, the switching transistor, the compensating transistor, the first initializing transistor, the first emission controlling transistor, the second emission controlling transistor, and the second initializing transistor is implemented with an N-type metal-oxide-semiconductor (NMOS) transistor.

6. The display device of claim 1, wherein the display panel includes a plurality of pixels, and each of the plurality of pixels includes:

a driving transistor configured to generate a driving current;

a first switching transistor configured to transfer a data signal;

a storage capacitor configured to store the data signal transferred through the first switching transistor;

a second switching transistor configured to connect the storage capacitor and the driving transistor to an initialization line;

an emission controlling transistor configured to connect a line of a power supply voltage to the driving transistor; and a display element configured to emit light based on the driving current, and wherein at least first one of the driving transistor, the first switching transistor, the second switching transistor, and the emission controlling transistor is implemented with a PMOS transistor, and at least second one of the driving transistor, the first switching transistor, the second switching transistor, and the emission controlling transistor is implemented with an NMOS transistor.

7. The display device of claim 1, wherein the panel driver includes:

a still image detector configured to detect whether the input image data represent the still image by comparing the input image data in a previous frame and the input image data in a current frame;

a driving frequency changer configured to provide output image data at the first output frame frequency in the first case where the input image data represent the dynamic image, and to provide the output image data at the second output frame frequency that is determined based on the plurality of flicker indexes in the second case where the input image data represent the still image; and a data driver configured to provide data signals to a plurality of pixels of the display panel based on the output image data.

8. The display device of claim 7, wherein the driving frequency changer includes:

a color-constant lookup table configured to store first through sixth sensitivity correlation constants for the first color, the second color, the third color, the first combination, the second combination, and the third combination;

a flicker index calculation block configured to calculate first, second, and third average gray values for the first, second, and third colors based on the input image data, to perform a color conversion operation on the input image data, to calculate fourth, fifth, and sixth average gray values for the first, second, and third combinations based on the input image data on which the color conversion operation is performed, and to calculate first through sixth flicker indexes as the plurality of flicker indexes by multiplying the first through sixth average gray values by the first through sixth sensitivity correlation constants, respectively;

a flicker-frequency lookup table configured to store a plurality of driving frequencies respectively corresponding to a plurality of flicker index ranges; and a driving frequency decision block configured to read first through sixth driving frequencies respectively corresponding to the first through sixth flicker indexes from the flicker-frequency lookup table, to determine the second output frame frequency as a maximum frequency of the first through sixth driving frequencies, and to provide the output image data at the second output frame frequency.

9. The display device of claim 8, wherein the first color is a red color, the second color is a green color, the third color is a blue color, the first combination is a yellow color, the second combination is a magenta color, and the third combination is a cyan color, and wherein the color conversion operation performed by the flicker index calculation block is a red/green/blue (RGB)-to-cyan/magenta/yellow/black (CMYK) conversion operation.

10. The display device of claim 8, wherein the color-constant lookup table stores the first through sixth sensitivity correlation constants at each of a plurality of gray ranges, and wherein the flicker index calculation block receives the first through sixth sensitivity correlation constants from the color-constant lookup table that respectively correspond to the first through sixth average gray values and calculates the first through sixth flicker indexes by multiplying the first through sixth average gray values by the first through sixth sensitivity correlation constants, respectively.

11. The display device of claim 8, wherein the flicker index calculation block divides the input image data for one frame into a plurality of segment image data for a plurality of segments, calculates the first through sixth average gray values at each of the plurality of segments based on the plurality of segment image data, and calculates the first through sixth flicker indexes at each of the plurality of segments by multiplying the first through sixth average gray values at each of the plurality of segments by the first through sixth sensitivity correlation constants, respectively, and wherein the driving frequency decision block reads the first through sixth driving frequencies at each of the plurality of segments respectively corresponding to the first through sixth flicker indexes at each of the plurality of segments from the flicker-frequency lookup table, determines each of a plurality of segment maximum driving frequencies at the plurality of segments as a segment maximum frequency of the first through sixth driving frequencies at each of the plurality of segments, and determines the second output frame frequency as a maximum frequency of the plurality of segment maximum driving frequencies at the plurality of segments.

12. The display device of claim 7, wherein the driving frequency changer includes:

a color-constant lookup table configured to store first through sixth sensitivity correlation constants for the first color, the second color, the third color, the first combination, the second combination, and the third combination;

a flicker index calculation block configured to calculate first, second, and third average gray values for the first, second, and third colors based on the input image data, to perform a color conversion operation on the input image data, to calculate fourth, fifth, and sixth average gray values for the first, second, and third combinations based on the input image data on which the color conversion operation is performed, and to calculate first through sixth flicker indexes as the plurality of flicker indexes by multiplying the first through sixth average gray values by the first through sixth sensitivity correlation constants, respectively;

first through sixth flicker-frequency lookup tables respectively corresponding to the first color, the second color, the third color, the first combination, the second combination, and the third combination, each of the first through sixth flicker-frequency lookup tables being configured to store a plurality of driving frequencies respectively corresponding to a plurality of flicker index ranges; and a driving frequency decision block configured to read first through sixth driving frequencies corresponding to the first through sixth flicker indexes from the first through sixth flicker-frequency lookup tables, respectively, to determine the second output frame frequency as a maximum frequency of the first through sixth driving frequencies, and to provide the output image data at the second output frame frequency.

13. A method of operating a display device, the method comprising:

receiving input image data corresponding to a first color, a second color, and a third color at an input frame frequency;

detecting whether the input image data represent a still image or a dynamic image;

in a first case where the input image data represent the dynamic image, driving a display panel of the display device at a first output frame frequency that is equal to or substantially the same as the input frame frequency;

in a second case where the input image data represent the still image, calculating a plurality of flicker indexes of the still image for at least two of the first color, the second color, the third color, a first combination of the first color and the second color, a second combination of the first color and the third color, and a third combination of the second color and the third color based on the input image data;

determining a second output frame frequency based on the plurality of flicker indexes; and driving the display panel at the second output frame frequency.

14. The method of claim 13, wherein the second output frame frequency is lower than the input frame frequency.

15. The method of claim 13, wherein the first color is a red color, the second color is a green color, the third color is a blue color, the first combination is a yellow color, the second combination is a magenta color, and the third combination is a cyan color, and wherein the plurality of flicker indexes of the still image includes a red flicker index corresponding to the red color, a green flicker index corresponding to the green color, a blue flicker index corresponding to the blue color, a yellow flicker index corresponding to the yellow color, a magenta flicker index corresponding to the magenta color, and a cyan flicker index corresponding to the cyan color.

16. The method of claim 15, wherein determining the second output frame frequency based on the plurality of flicker indexes includes:

determining a plurality of driving frequencies respectively corresponding to the red flicker index, the green flicker index, the blue flicker index, the yellow flicker index, the magenta flicker index, and the cyan flicker index; and determining the second output frame frequency as a maximum frequency of the plurality of driving frequencies.

17. The method of claim 13, wherein detecting whether the input image data represent the still image includes:

comparing the input image data in a previous frame and the input image data in a current frame; and determining that the input image data represent the still image in the second case where the input image data in the current frame are equal to or substantially the same as the input image data in the previous frame.

18. The method of claim 13, wherein calculating the plurality of flicker indexes of the still image includes:

calculating first, second, and third average gray values for the first, second, and third colors based on the input image data;

performing a color conversion operation on the input image data;

calculating fourth, fifth, and sixth average gray values for the first, second, and third combinations based on the input image data on which the color conversion operation is performed;

reading the first through sixth sensitivity correlation constants for the first color, the second color, the third color, the first combination, the second combination, and the third combination from a color-constant lookup table; and calculating first through sixth flicker indexes as the plurality of flicker indexes by multiplying the first through sixth average gray values by the first through sixth sensitivity correlation constants, respectively.

19. The method of claim 18, wherein determining the second output frame frequency based on the plurality of flicker indexes includes:

reading first through sixth driving frequencies respectively corresponding to the first through sixth flicker indexes from a flicker-frequency lookup table; and determining the second output frame frequency as a maximum frequency of the first through sixth driving frequencies.

20. The method of claim 18, wherein determining the second output frame frequency based on the plurality of flicker indexes includes:

reading first through sixth driving frequencies corresponding to the first through sixth flicker indexes from first through sixth flicker-frequency lookup tables for the first color, the second color, the third color, the first combination, the second combination, and the third combination, respectively; and determining the second output frame frequency as a maximum frequency of the first through sixth driving frequencies.

* * * * *